US010368712B2

(12) United States Patent
Wydra

(10) Patent No.: US 10,368,712 B2
(45) Date of Patent: Aug. 6, 2019

(54) SURFACE MAINTENANCE VEHICLE WITH SELF-CLEANING RESERVOIR THAT CAPTURES HOSE RUNOFF

(71) Applicant: Tennant Company, Minneapolis, MN (US)

(72) Inventor: Larry David Wydra, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 897 days.

(21) Appl. No.: 14/302,670

(22) Filed: Jun. 12, 2014

(65) Prior Publication Data

US 2014/0366317 A1 Dec. 18, 2014

Related U.S. Application Data

(60) Provisional application No. 61/835,264, filed on Jun. 14, 2013.

(51) Int. Cl.

| | |
|---|---|
| ***A47L 7/00*** | (2006.01) |
| ***A47L 11/30*** | (2006.01) |
| ***A47L 11/40*** | (2006.01) |

(52) U.S. Cl.

CPC ..... *A47L 11/4044* (2013.01); *A47L 7/0014* (2013.01); *A47L 11/30* (2013.01); *A47L 11/4027* (2013.01)

(58) Field of Classification Search

CPC .. A47L 11/4044; A47L 11/4027; A47L 11/30; A47L 7/0014

(Continued)

(56) References Cited

U.S. PATENT DOCUMENTS 1,042,711 A * 10/1912 Moorhead ..... A47L 11/4044 15/322
2,822,061 A 2/1958 Pettit et al.

(Continued)

FOREIGN PATENT DOCUMENTS

CN 1765276 A 5/2006
CN 1883355 A 12/2006

(Continued)

OTHER PUBLICATIONS

BETCO Stealth ASD20BT, Operator and Parts Manual, 20" Automatic Scrubber with Traction Drive, Oct. 2011, 52 pages.

(Continued)

*Primary Examiner* — Andrew A Horton
(74) *Attorney, Agent, or Firm* — Fredrikson & Byron, P.A.

(57) ABSTRACT

Certain embodiments include a fluid recovery system. The fluid recovery system includes a vacuum system that applies a suction force on fluids on the floor surface to draw fluids to a fluid recovery tank. A reservoir is operably coupled to a recovery hose. The reservoir includes an inlet passage, an outlet passage leading to the recovery hose, and a fluid trap portion positioned between the inlet and outlet passages. The reservoir permits passage therethrough of fluids suctioned by the vacuum system from the floor to the recovery hose, and traps a backflow of fluids from the recovery hose in the fluid trap portion when the vacuum system stops suctioning fluids from the floor to the recovery hose. The reservoir is shaped to be generally self-cleaning and clears most fluids trapped in the fluid trap portion when the vacuum system starts suctioning fluids from the floor to the recovery hose.

19 Claims, 30 Drawing Sheets

(58) Field of Classification Search
USPC ..... 15/320–322, 401
See application file for complete search history.

(56) References Cited

U.S. PATENT DOCUMENTS

| | | | | |
|---|---|---|---|---|
| 4,571,771 | A | 2/1986 | Worwa | |
| 5,802,665 | A | 9/1998 | Knowlton et al. | |
| 5,901,407 | A | 5/1999 | Boomgaarden | |
| 6,047,437 | A * | 4/2000 | Suzuki | A47L 11/4044 15/245 |
| 2002/0184729 | A1 * | 12/2002 | Farina | A47L 11/4044 15/322 |
| 2003/0208873 | A1 | 11/2003 | Chang | |

FOREIGN PATENT DOCUMENTS

| | | | |
|---|---|---|---|
| EP | 1929913 | A1 | 6/2008 |
| EP | 1929913 | A1 | 11/2008 |
| JP | H05-084212 | A | 4/1993 |
| JP | 3366209 | B2 | 1/2003 |

OTHER PUBLICATIONS

International Search Report and Written Opinion for International Application No. PCT/US2014/042108, dated Oct. 28, 2014; 12 pages.

Minuteman International, Inc., Minutman ES 260/320, "Walk-Behind Automatic Scrubber," www.minutemanintl.com, 4 pages, Oct. 21, 2013.

* cited by examiner

SURFACE MAINTENANCE VEHICLE WITH SELF-CLEANING RESERVOIR THAT CAPTURES HOSE RUNOFF

CROSS REFERENCE TO RELATED APPLICATION

This application claims priority to U.S. patent application Ser. No. 61/835,264, filed Jun. 14, 2013 and titled "SURFACE MAINTENANCE VEHICLE WITH SELF-CLEANING RESERVOIR THAT CAPTURES HOSE RUNOFF." The entire content of this application is incorporated herein by reference.

FIELD OF THE INVENTION

The present invention generally relates to fluid recovery systems of surface cleaning machines having a self-cleaning reservoir.

BACKGROUND OF THE INVENTION

Floor cleaning in public, commercial, institutional and industrial buildings have led to the development of various specialized floor cleaning machines, such as hard and soft floor cleaning machines. These cleaning machines generally utilize a cleaning head that includes one or more cleaning tools configured to perform the desired cleaning operation on the floor surface. These cleaning machines include dedicated floor sweeping machines, dedicated floor scrubbing machines and combination floor sweeping and scrubbing machines.

An example of a dedicated hard floor sweeping and scrubbing machine is described in U.S. Pat. No. 5,901,407, which is assigned to Tennant Company of Minneapolis, Minn. and which is hereby incorporated by reference in its entirety. The machine uses a cleaning head having two cleaning tools in the form of cylindrical brushes. The cleaning tools counter-rotate in the directions indicated by the arrows shown. Water and detergent are sprayed on the floor ahead of the brushes so the brushes can scour the floor at the same time they are sweeping debris from the floor. A vacuum squeegee removes liquid waste from the floor during the wet scrubbing and sweeping operations. The cleaning tools engage each other such that debris on the floor is swept between the two cleaning tools and is directed into a waste hopper by a deflector.

An example of a dedicated floor sweeper is described in U.S. Pat. No. 4,571,771, which is assigned to Tennant Company of Minneapolis, Minn. and is hereby incorporated by reference in its entirety. The floor sweeper includes a cleaning head comprised of a rotating cylindrical brush that contacts the floor and throws loose debris into a hopper which is periodically emptied either manually or through a motorized lift. Combination floor sweeping and scrubbing machines were developed to avoid the necessity of having two machines. Some floor sweeping and scrubbing machines were created by mounting sweeping components to the front end of a dedicated scrubbing machine to making one large, multi-function machine.

When a surface maintenance machine performs wet scrubbing operation, water and detergent from a solution tank are sprayed or poured on the floor through a solution valve to the brushes. As the surface maintenance machine moves forward, a squeegee wipes the waste water off the floor, and a vacuum system applies suction to remove the waste water from the floor upwards through a recovery hose and into a recovery tank. When the vacuum supply is turned off, any waste water still present in the recovery hose flows down to the floor due to lack of suction. This is referred to as hose runoff Hose runoff is typically prevented by tying a knot or including a loop in the recovery hose.

Some prior art means for preventing hose runoff include a narrow water trap built on top of a vacuum squeegee. The waste water collects inside the water trap and is emptied with the assistance of jets of air created by the vacuum system. The shape of the water trap introduces swirling vortices from the air jets created by the vacuum system. These swirling vortices are deployed to remove water and debris from the water trap prior to shutting off the vacuum to prevent over flow of the water trap. The prior art water traps comprise fasteners and mounting means for the water trap on the squeegee, increasing the packaging and footprint. Additionally, the water traps mounted on the squeegee are limited by the dimensions of the squeegee, resulting in shapes that do not introduce swirling vortices of sufficient velocity to effectively remove waste water and debris from water trap. Such low velocity swirling vortices are also accompanied by large pressure losses. Designs that introduce large pressure losses in the recovery system require a larger capacity vacuum fan for drawing the same quantity of waste water in comparison to designs with lower pressure losses. Large pressure losses also translate to a higher input power to the larger capacity vacuum fan and loss of overall efficiency of the recovery system. In addition, the shape of the water trap may also allow non-uniform velocity of fluids at the inlet of the water trap resulting in "dead zones" that permit accumulation of debris.

SUMMARY

Certain embodiments of the present invention include a floor surface maintenance machine that has a frame, a scrub head, and a fluid recovery system. In certain embodiments the fluid recovery system includes a squeegee, a recovery hose, a vacuum system and a self-cleaning reservoir. The surface maintenance machine sprays or pours water or a cleaning liquid on the surface beneath the machine, and brushes coupled to the scrub head scrub the surface. The soiled liquid is collected by the fluid recovery system. The squeegee wipes the waste water solution off the floor, which is then picked up and drawn into the recovery hose by the vacuum system. The recovery hose is coupled to the self-cleaning reservoir by hose clamps, flanges or other means. The self-cleaning reservoir is fabricated as a single part that includes an inlet passage, an outlet passage, and a fluid trap portion. The fluid trap portion is of rounded shape and has a rounded clearance above the inlet passage that allows air jets to form and move in rotational motion in the fluid trap portion. The rounded shape of the fluid trap portion, and the rounded clearance permit waste water and debris collected from the surface to be emptied out of the self-cleaning reservoir while the vacuum system is operational, ensuring that waste water does not stagnate in the recovery hose and cause hose runoff when the vacuum system is not operational.

Certain embodiments of the present invention include a floor surface maintenance machine that has a frame, a scrub head, and a fluid recovery system. In certain embodiments the fluid recovery system includes a squeegee, a recovery hose, a vacuum system and a self-cleaning reservoir. The self-cleaning reservoir is fabricated as a single part that includes an inlet passage, an outlet passage, a fluid trap portion, a nose and a flow splitter. When the vacuum system is operational, waste water and debris flow from the inlet passage, and is split into two either by the shape of the fluid trap portion or by the flow splitter, or both. Two jets, a first jet flowing in a curvilinear direction away from the nose and a second jet flowing towards the nose in a rotational direction are formed. The first jet moves with a velocity much smaller than the velocity of the waste water at inlet. Any waste water and debris not removed from the self-cleaning reservoir stagnates in the reservoir and nose and will be cleaned during the next use of the surface maintenance machine.

Certain embodiments of the present invention include a floor surface maintenance machine that has a frame, a scrub head, and a fluid recovery system. In certain embodiments, the fluid recovery system includes a squeegee, a recovery hose, a vacuum system and a self-cleaning reservoir. In certain embodiments, the self-cleaning reservoir comprises an inlet passage, an outlet passage, a fluid trap portion and at least one guide trough. The inlet and outlet passages can have substantial overlap to minimize footprint of the self-cleaning reservoir on the surface maintenance machine. When the vacuum system is operational, waste water and debris flow from the inlet passage to the outlet passage by following the curvature of the fluid trap portion. The curvature of the fluid trap portion introduces air jets that move in a rotational direction, facilitating movement of waste water and debris from the regions in the fluid trap portion where they tend to stagnate. The guide troughs are contoured surfaces on the walls of the self-cleaning reservoir that guide the waste water and debris to collect in the fluid trap portion when the vacuum system is not operational to be cleaned during the next use of the surface maintenance machine. The guide troughs ensure that waste water does not have a line of sight and flow from the outlet passage back to the inlet passage when the vacuum system is not operational.

Certain embodiments of the present invention include a floor surface maintenance machine that has a frame, a scrub head, and a fluid recovery system. In certain embodiments, the fluid recovery system includes a squeegee, a recovery hose, a vacuum system and a self-cleaning reservoir. In certain embodiments, the self-cleaning reservoir comprises an inlet passage, an outlet passage, a fluid trap portion and an inclined portion. The inlet and outlet passages can have substantial overlap to minimize footprint of the self-cleaning reservoir on the surface maintenance machine. When the vacuum system is operational, waste water and debris flow from the inlet passage to the outlet passage by following the curvature of the fluid trap portion. The waste water and debris collected in the fluid trap portion can then be cleaned during the next use of the surface maintenance machine. The curvature of the fluid trap portion introduces air jets that move in a rotational direction, facilitating movement of waste water and debris from the regions in the fluid trap portion where they tend to stagnate. The inclined portion guides the waste water and debris to collect in the fluid trap portion when the vacuum system is not operational. The inclined portion ensures that waste water does not have a line of sight and flow from the outlet passage back to the inlet passage when the vacuum system is not operational. The inclined portion is characterized by an angle of inclination. The angle of inclination of the inclined portion determines whether waste water will collect in the fluid trap portion.

Certain embodiments of the present invention include a floor surface maintenance machine that has a frame, a scrub head, and a fluid recovery system. In certain embodiments, the fluid recovery system includes a squeegee, a recovery hose, a vacuum system and a self-cleaning reservoir. In certain embodiments, the self-cleaning reservoir comprises an inlet passage, an outlet passage, a fluid trap portion and an indentation. The inlet and outlet passages can have substantial overlap to minimize footprint of the self-cleaning reservoir on the surface maintenance machine. The indentation is characterized by a radius of curvature of the indentation. When the vacuum system is operational, waste water and debris flow from the inlet passage to the outlet passage by following the curvature of the fluid trap portion. The curvature of the fluid trap portion introduces air jets that move in a rotational direction, facilitating movement of waste water and debris from the regions in the fluid trap portion where they tend to stagnate. The indentation guides the waste water and debris to collect in the fluid trap portion when the vacuum system is not operational. The indentation ensures that waste water does not have a line of sight and flow from the outlet passage back to the inlet passage when the vacuum system is not operational.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

Figure 1:
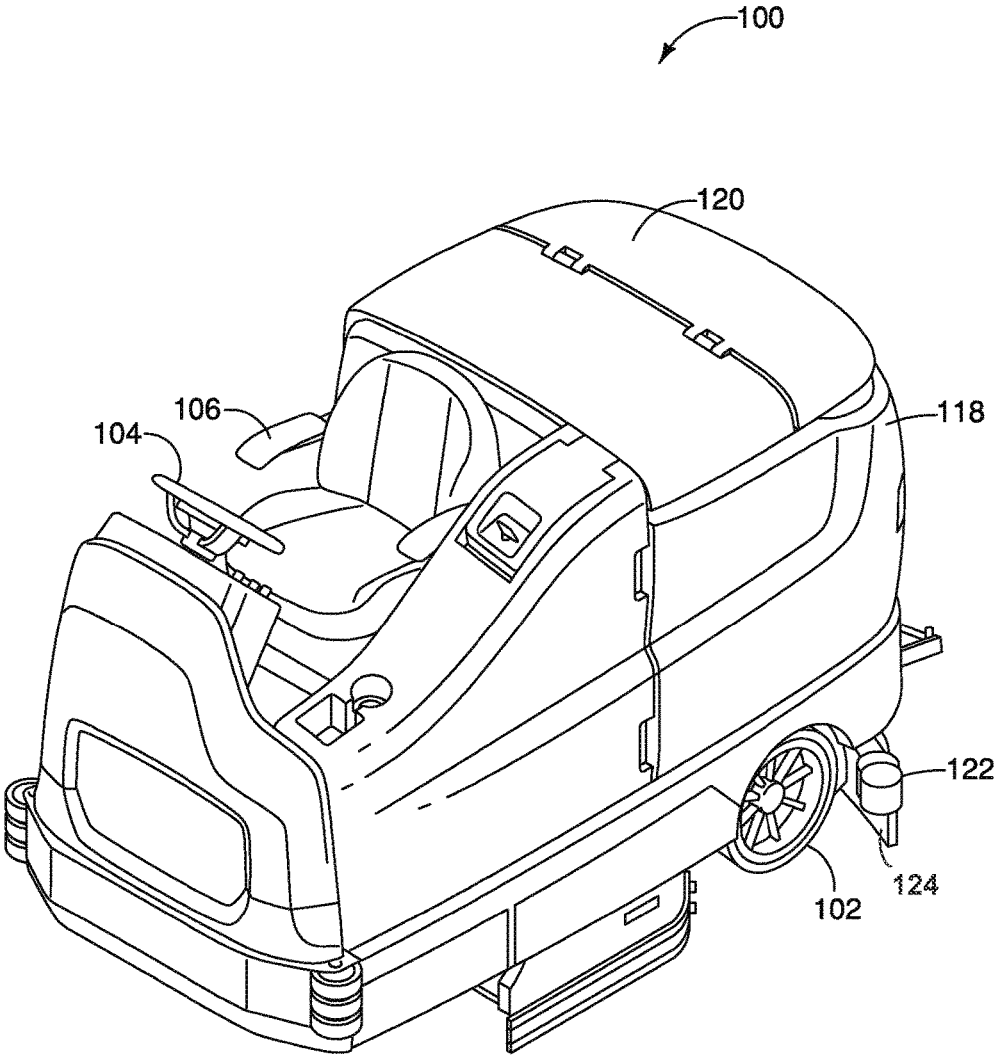
FIG. 1 is an upper perspective view of an exemplary floor surface cleaning machine employing an embodiment of the self-cleaning reservoir of the present invention.
Figure 2:
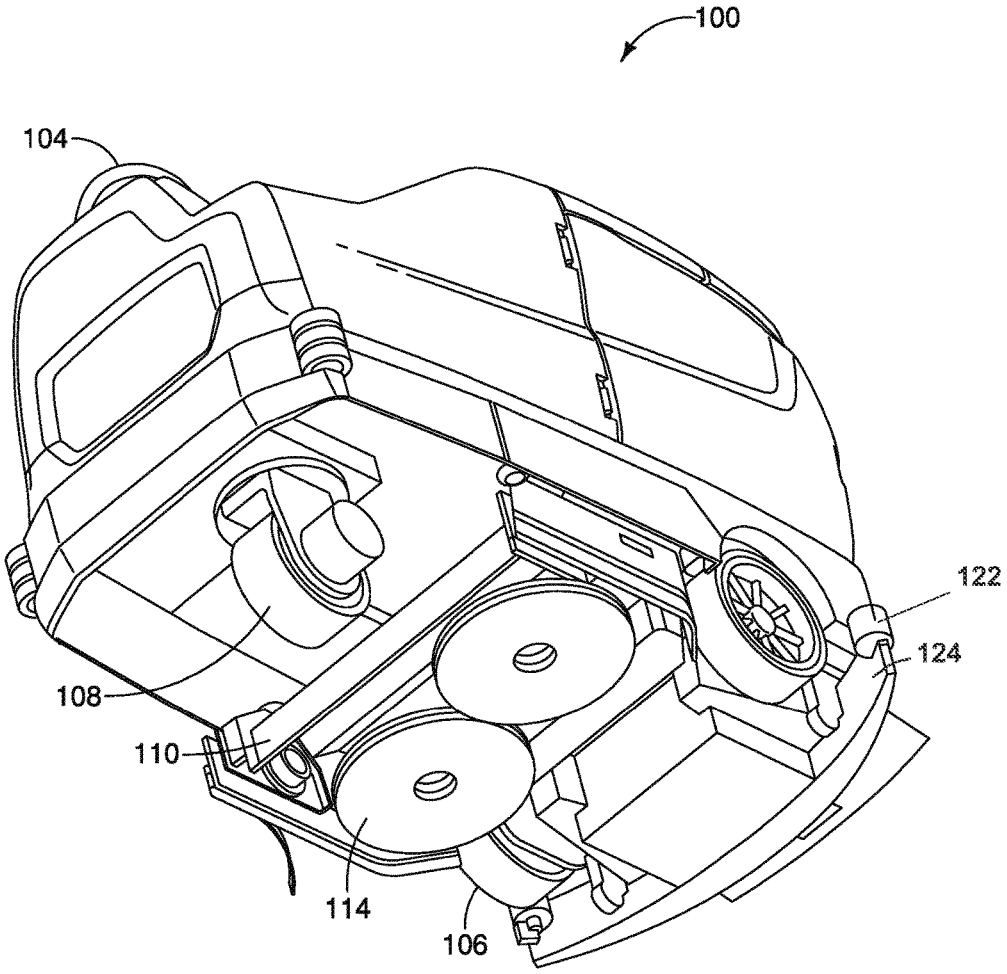
FIG. 2 is a lower perspective view of an exemplary floor surface cleaning machine employing an embodiment of the self-cleaning reservoir of the present invention.

FIGS. 1 and 2 are upper and lower perspective views, respectively, of an exemplary floor surface cleaning machine 100. Embodiments of the machine 100 include components that are supported on a motorized mobile body. The mobile body comprises a frame supported on wheels 102 for travel over a surface, on which a cleaning operation is to be performed. The mobile body includes operator controls and a steering wheel 104, which is positioned with respect to a seat 106 of machine 100, so that a seated operator of machine 100 may steer a front center wheel 108 of machine 100. Machine 100 is preferably powered by one or more batteries that may be contained in a compartment beneath the seat. Alternately, the power source may be an internal combustion engine, powered through an electrical cord, or one or more power cells, may be employed to power machine 100.

Cleaning components extend from an underside of the machine 100. For example, a scrub head 110 is shown located at a middle portion of machine 100. The scrub head 110 has a housing that encloses two scrub brushes 114. The brushes 114 are driven by two electric motors. An electric actuator attached between the scrub head 110 and the housing raises the scrub head 110 for transport, lowers it for work, and controls its down pressure on the floor. The scrub head 110 uses two disk scrub brushes 114 rotating about parallel vertical axes. Alternatively, scrub heads may be made with only one disk scrub brush, or one or more cylindrical brushes rotating about horizontal axes. While a scrub head 110 is depicted in the drawing figures, any appliance or tool for providing surface maintenance, surface conditioning, and/or surface cleaning to a surface may be coupled to an associated machine or vehicle in accordance with the present invention.

Vehicle 100 may include a side brush assembly for cleaning a larger floor envelope. Such side brush assemblies make it easier to clean near walls or other obstacles without damaging the machine or the wall while at the same time widening the cleaning path of the machine to increase productivity.

During wet scrubbing operations, water or a cleaning liquid contained in a tank 118 is sprayed to or poured on the surface beneath machine 100, in proximity to the scrub head 110. Brushes 114 scrub the surface and the soiled cleaning liquid is then collected by a fluid recovery system and deposited in a waste recovery tank 120. One embodiment of the fluid recovery system of the machine 100 includes a vacuum squeegee mounted adjacent the rear end of the machine 100 on a frame 122 that supports the squeegee. The vacuum squeegee also includes a vacuum port that is placed in vacuum communication with a vacuum fan. The vacuum fan operates to remove liquid and particle waste collected by the vacuum squeegee for deposit in the waste recovery tank 120.

In alternate embodiments, the floor surface maintenance machines 100 may be combination sweeper and scrubber machines. In such embodiments, in addition to the elements describe above, the machines 100 may also include sweeping brushes and a hopper extending from the underside of the machine 100, with the sweeping brushes designed to direct dirt and debris into the hopper. Alternatively, the machine 100 may be designed for use by an operator that walks behind the machine, or the machine may be configured to be towed behind a vehicle.

Figure 3:
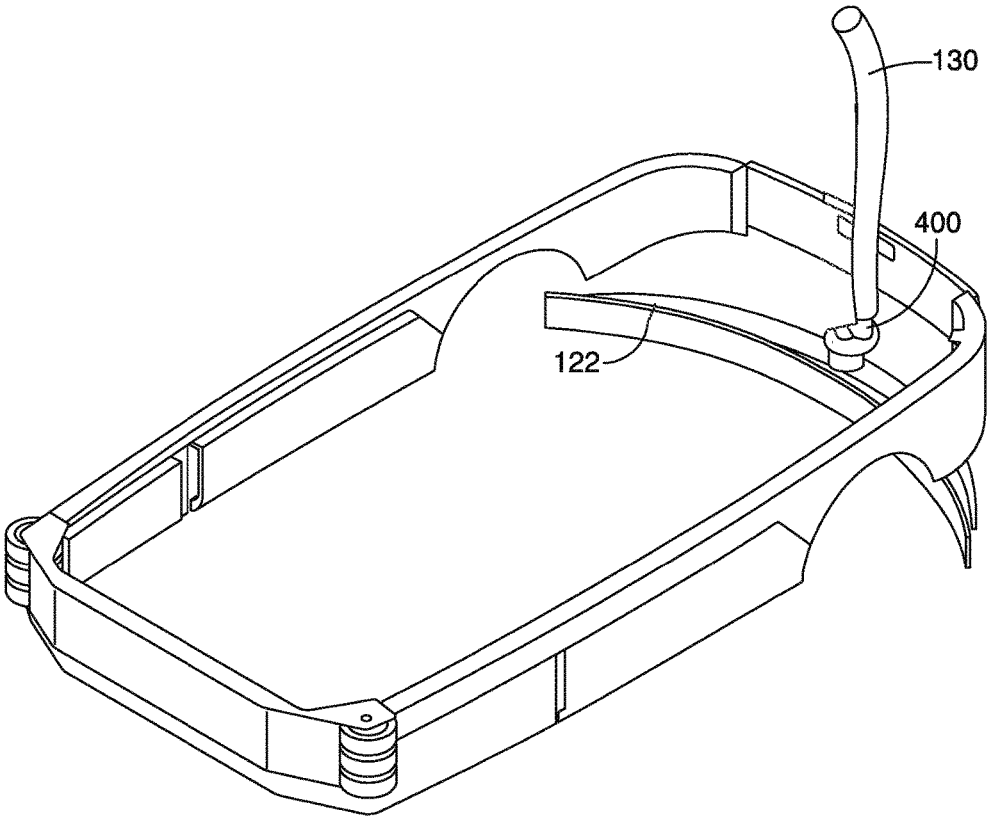
FIG. 3 is an upper perspective view of a frame of the machine of FIG. 1 and a portion of an embodiment of the self-cleaning reservoir of the present invention.
Figure 4:
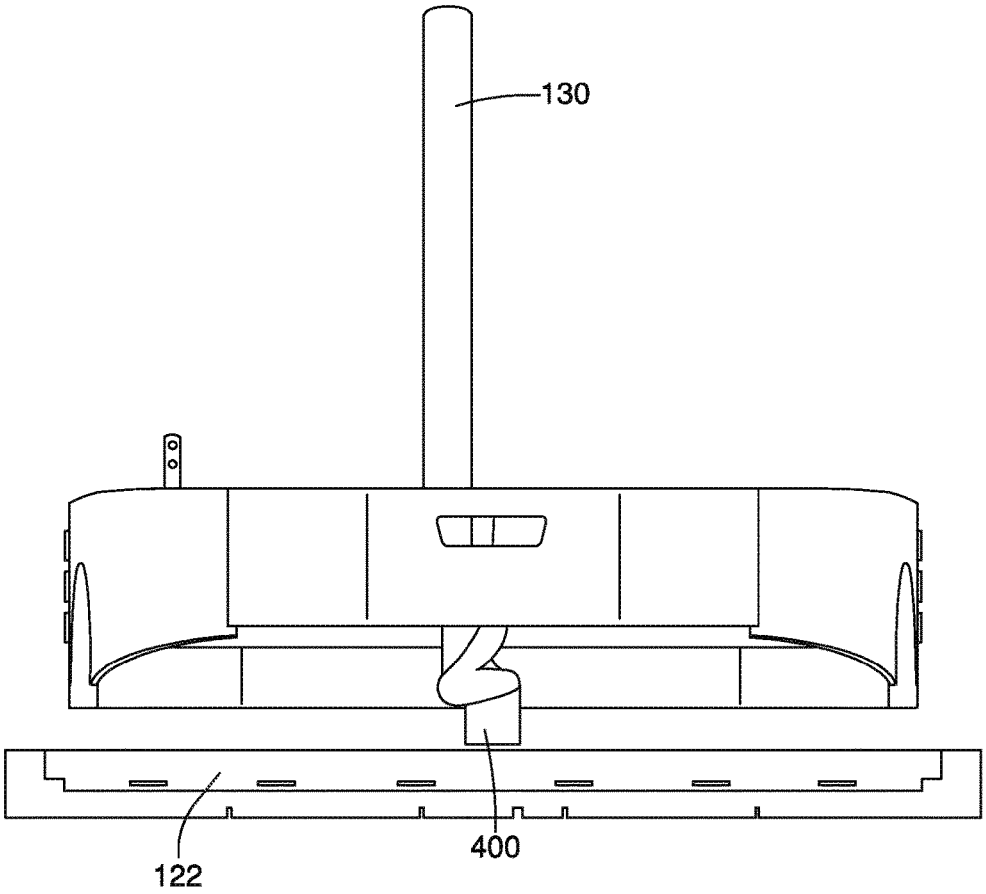
FIG. 4 is a rear elevation view of a frame of the machine of FIG. 1 and the portion of an embodiment of the self-cleaning reservoir of the present invention.
Figure 5:
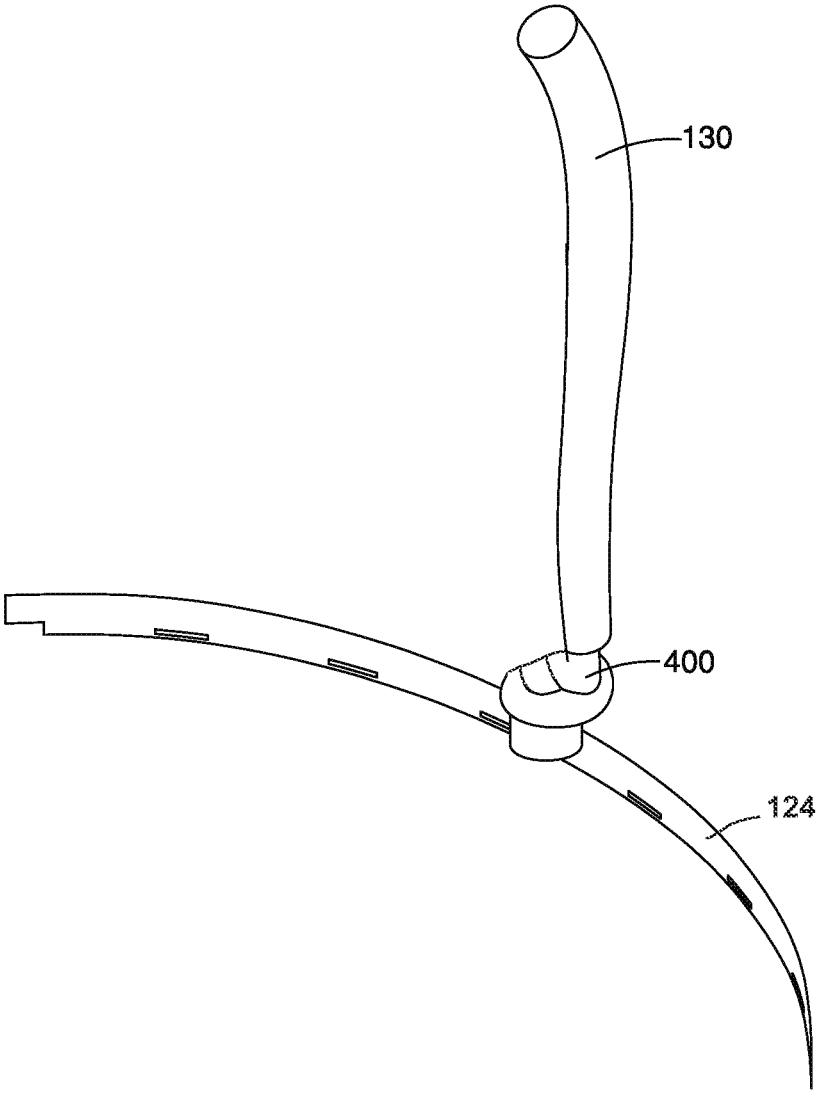
FIG. 5 is an upper perspective view of a frame of a squeegee of the machine of FIG. 1 portion of an embodiment of the self-cleaning reservoir of the present invention.
Figure 6:
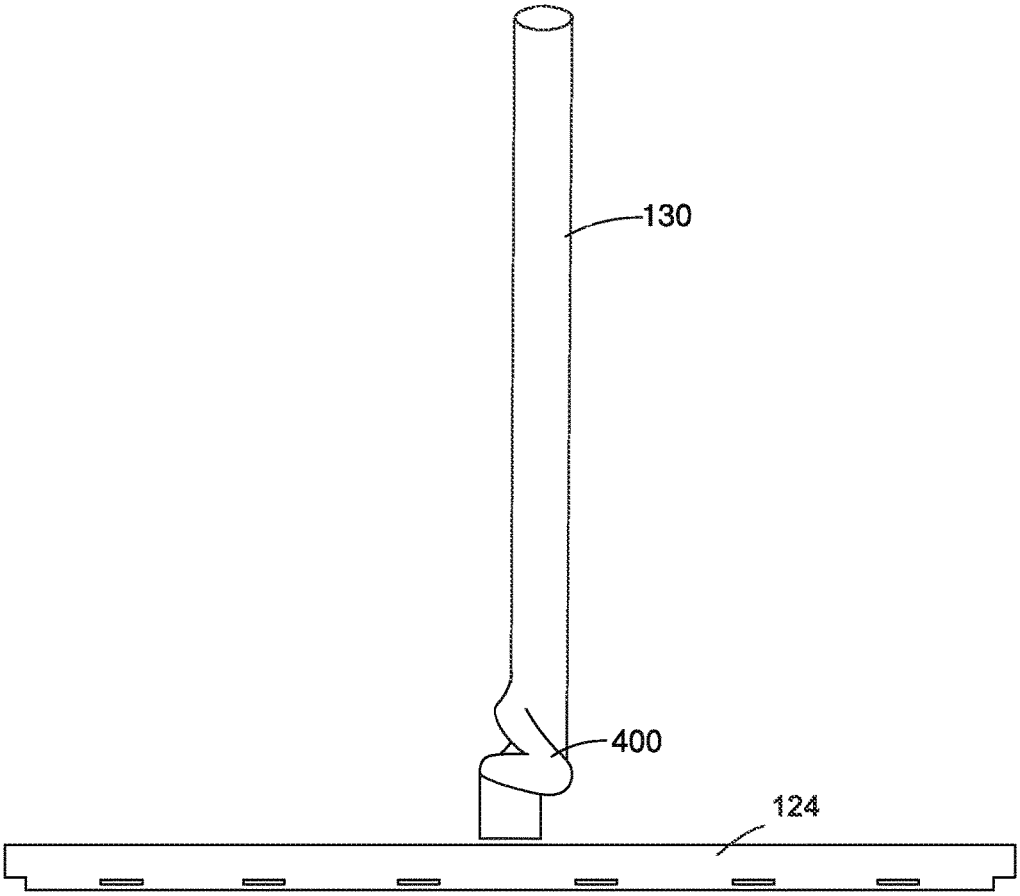
FIG. 6 is a rear elevation view of a frame of a squeegee of the machine of FIG. 1 and the portion of an embodiment of the self-cleaning reservoir of the present invention.

FIG. 3 is an upper perspective view of the machine 100 and a portion of the fluid recovery system. FIGS. 4, 5 and 6 are front elevation, perspective and rear elevation view of portions of the fluid recovery system. In FIGS. 3-6, several components of the machine are omitted for clarity. The fluid recovery system comprises a squeegee 124 supported on the frame 122 (best seen in FIGS. 1 and 2). A vacuum port (not shown) is placed in communication with a vacuum fan (not shown). When the vacuum fan is operational, it creates suction inside the recovery hose 130, collecting the liquid and particle debris from the surface. A self-cleaning reservoir 400 is coupled to the recovery hose 130 by employing hose clamps, flanges or other means of coupling.

Figure 7:
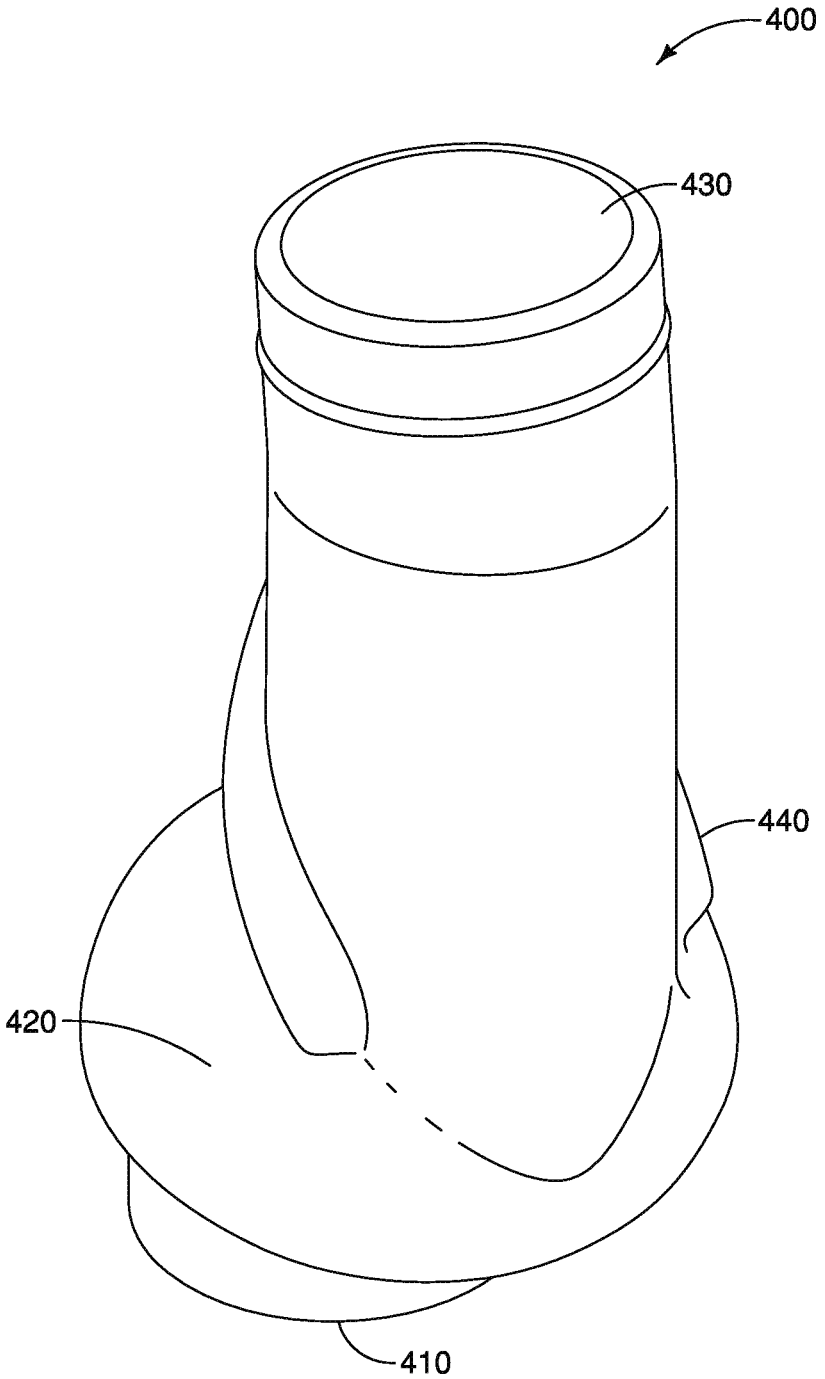
FIG. 7 is an upper perspective view of a portion of an embodiment of the self-cleaning reservoir of the present invention.
Figure 8:
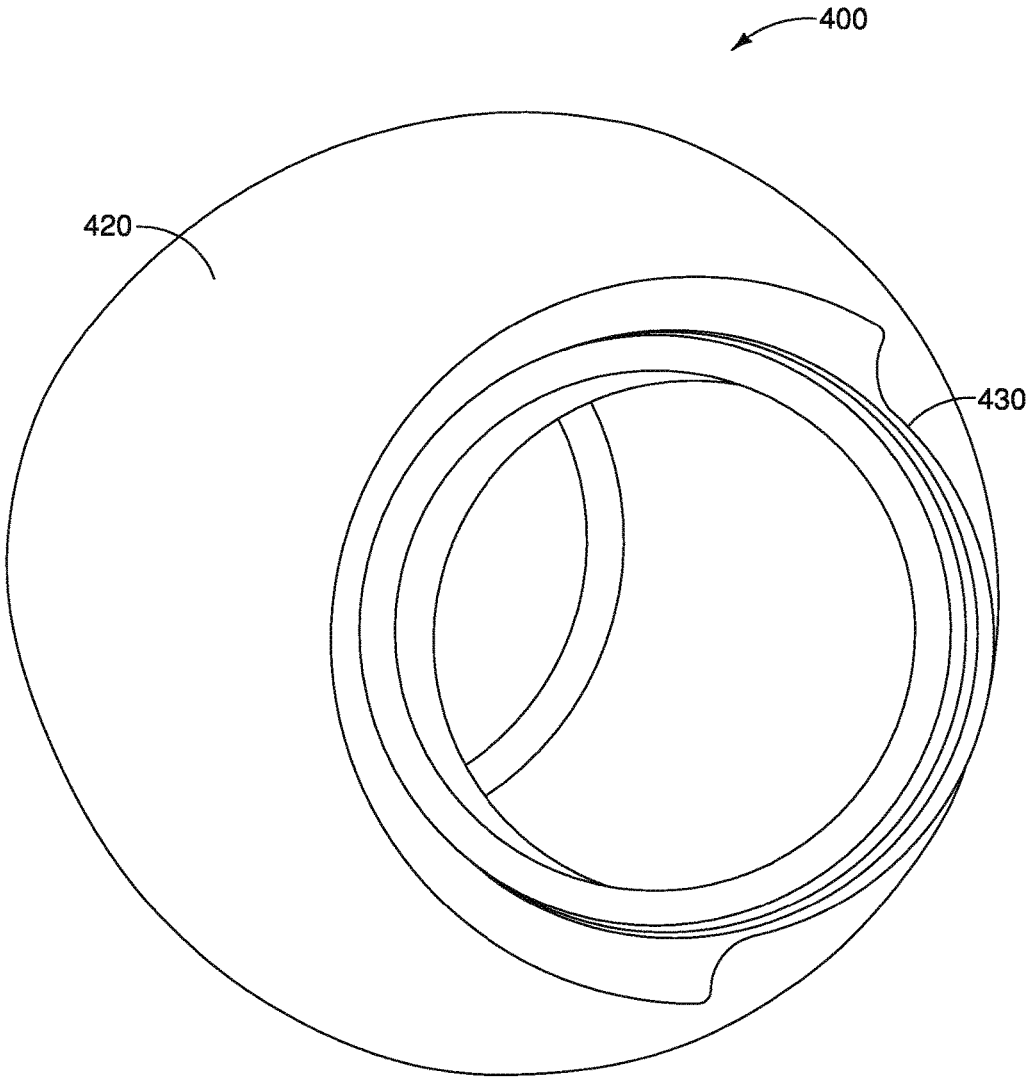
FIG. 8 is a top plan view a portion of an embodiment of the self-cleaning reservoir of FIG. 7.
Figure 9:
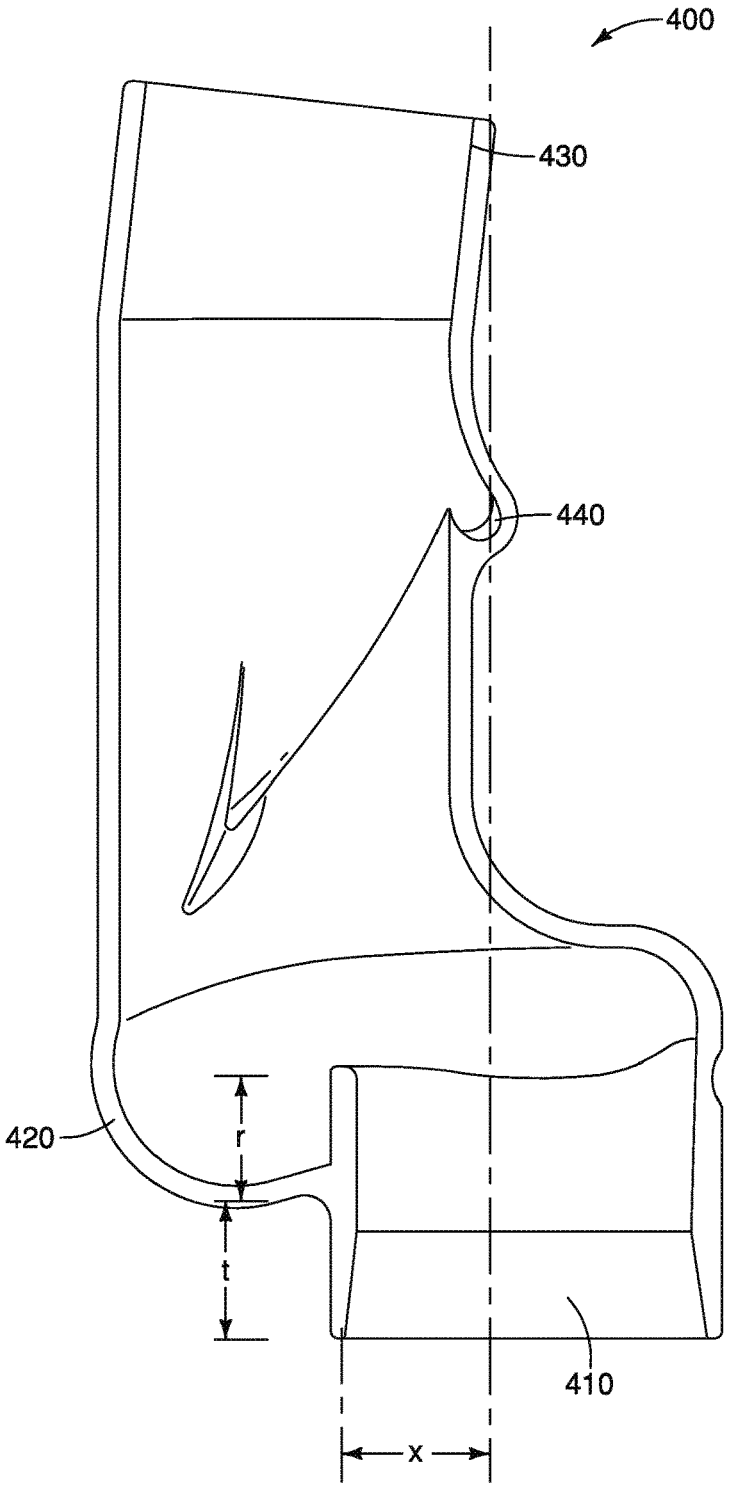
FIG. 9 is a cross-sectional view of a portion of the self-cleaning reservoir of FIG. 7.
Figure 10:
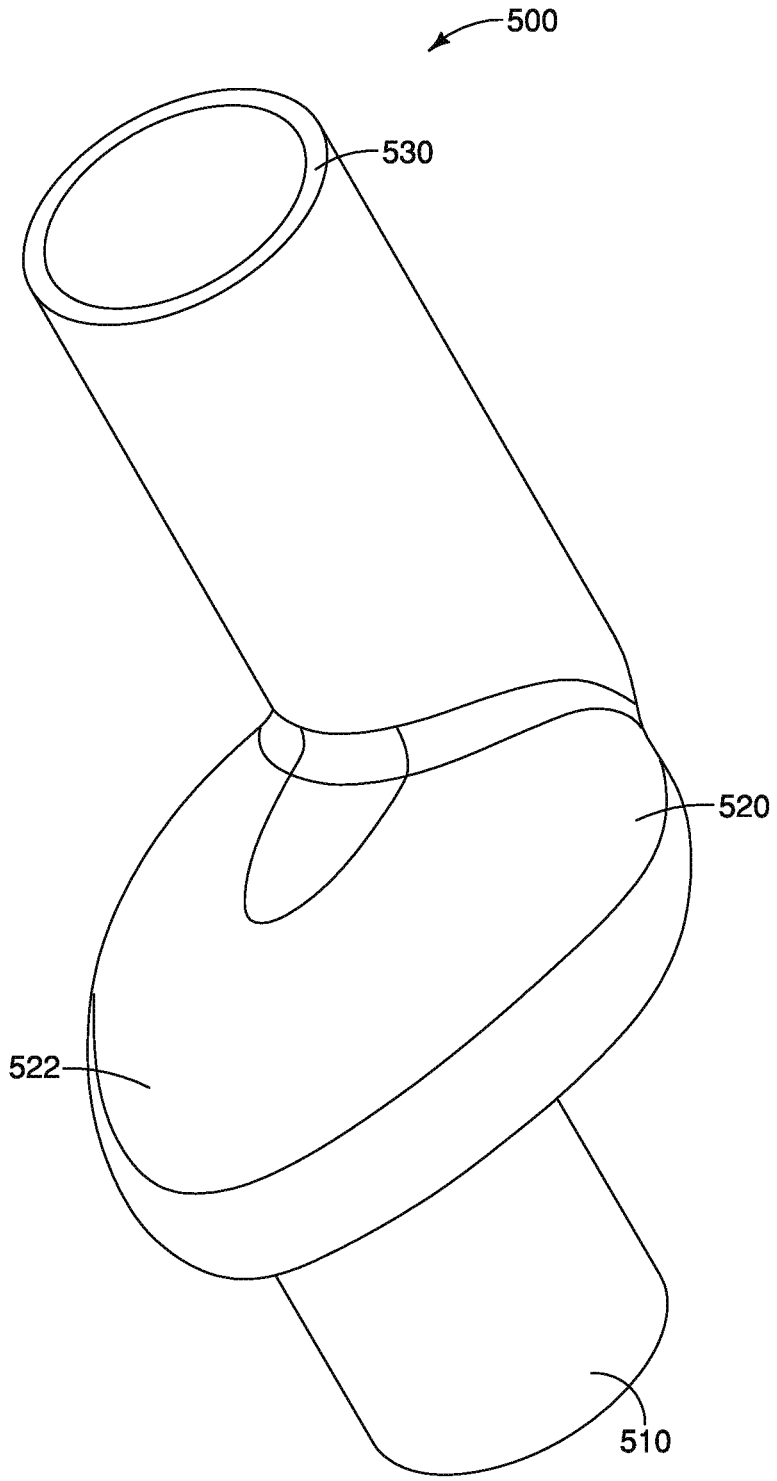
FIG. 10 is an upper perspective view of a portion of another embodiment of the self-cleaning reservoir of the present invention.
Figure 11:
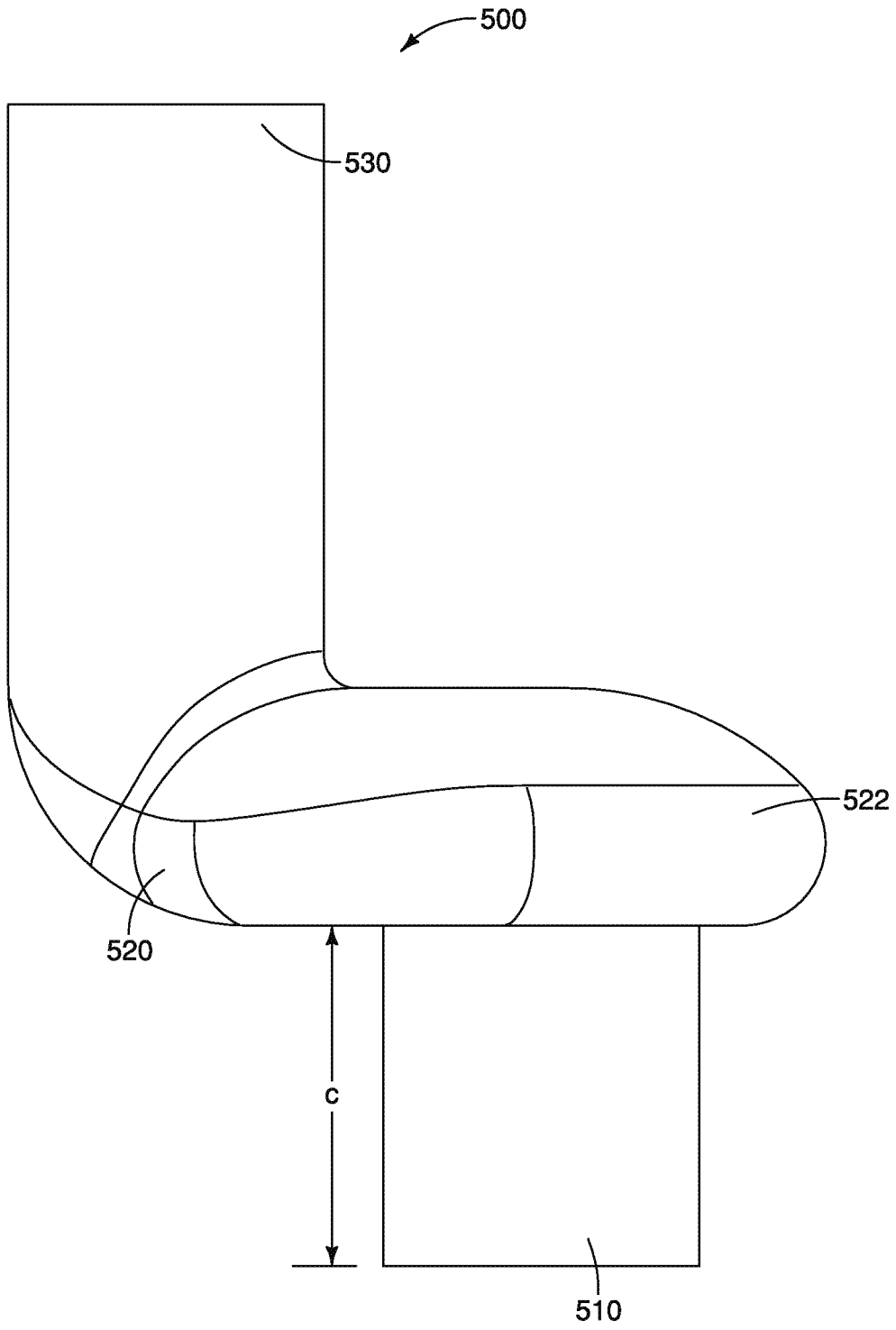
FIG. 11 is a front elevation view of a portion of the self-cleaning reservoir of FIG. 10.
Figure 12:
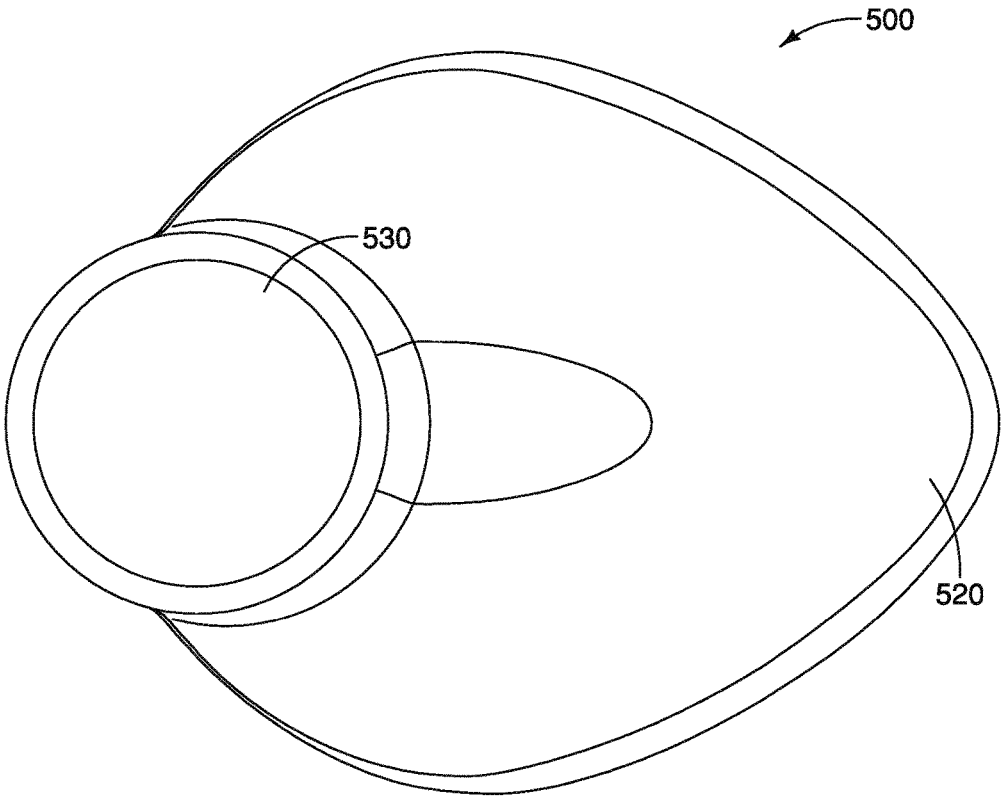
FIG. 12 is a top plan view of a portion of the self-cleaning reservoir of FIG. 10.
Figure 13:
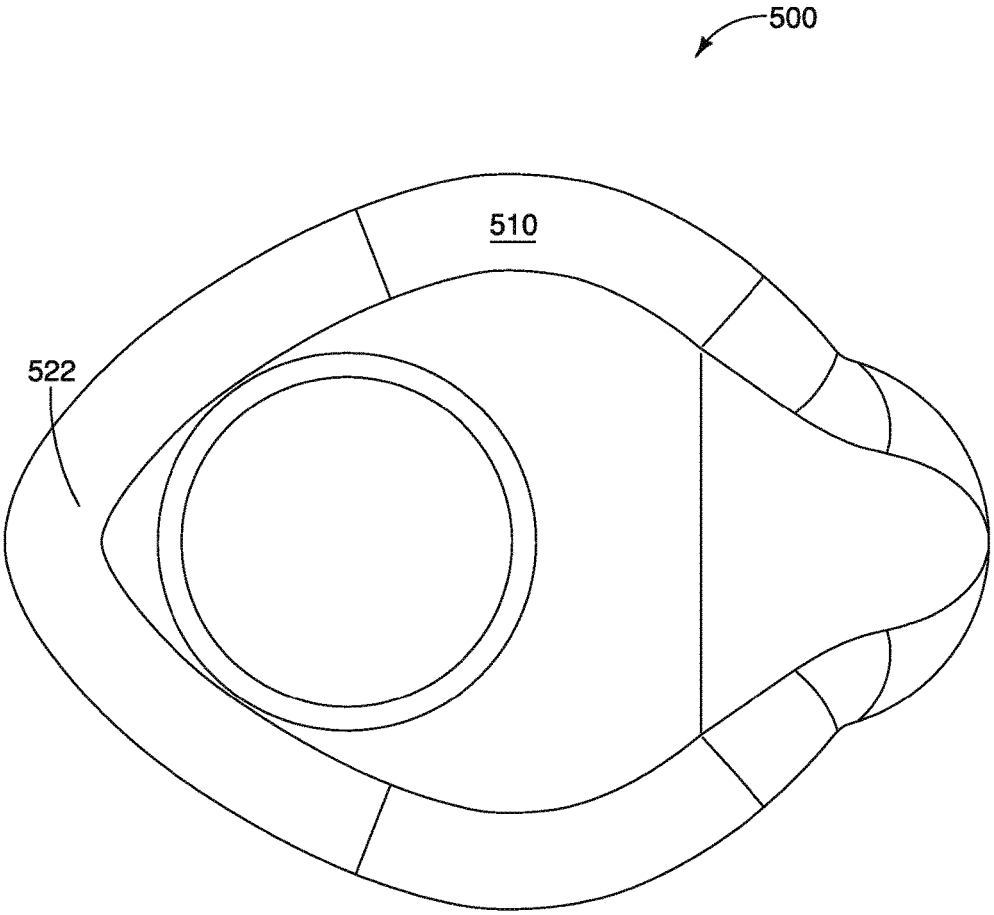
FIG. 13 is a bottom plan view a portion of the self-cleaning reservoir of FIG. 10.

FIG. 7 is an upper perspective view of the self-cleaning reservoir according to some embodiments. The self-cleaning reservoir comprises an inlet passage 410, guide troughs 440, a fluid trap portion 420, and an outlet passage 430. The self-cleaning reservoir may be fabricated as a single part facilitating the assembly of the self-cleaning reservoir on to the recovery hose. For instance, the inlet passage, 410, the fluid trap portion 420 and the outlet passage 430 can be formed integrally (e.g., by molding). Alternatively, the self-cleaning reservoir may be assembled from a plurality of pieces. For instance, the inlet passage 410, the fluid trap portion 420 and the outlet passage 430 may be separate pieces operatively connected (e.g., adhesives, fasteners, complementary threads etc.) to each other to form the self-cleaning reservoir. The inlet and outlet passages 410 and 430 are illustrated as having a circular cross-section. The shape of the inlet and outlet passages can be adapted to engage with a recovery hose or other water flow passageways. When the vacuum fan is operational, a suction force is created in the reservoir hose, resulting in movement of waste water on the inside area of the inlet passage 410. It is preferable to have sufficient clearance for the inlet passage 410 below the fluid trap portion 420 to allow the flow velocity to be nearly uniform at the inlet passage 410. Additionally, it is preferable to have a rounded contour immediately above the inlet passage 410 to allow the flow velocity to be nearly uniform. As illustrated in FIG. 9, the inlet passage extends a distance "r" into the self-cleaning reservoir forming a barrier in the fluid trap portion 420 ensuring that any waste water and debris collected in the fluid trap portion does not flow into the inlet passage 410. The fluid trap portion 420 has a rounded profile so that it does not act as a sharp corner to the fluids entering the self-cleaning reservoir, to prevent the fluids from slowing down at the sharp corner, thereby allowing the velocity of fluids to remain uniform at the inlet passage 410. As best seen in FIGS. 8 and 9, the inlet passage 410 and the outlet passage 430 overlap. A distance "x" indicates the extent of the overlap of the inlet and outlet passages 410 and 430. As shown in FIG. 9, "x" is the distance between the walls of the inlet and the outlet passages 410 and 430 respectively. It may be appreciated that the walls of the inlet passage is approximately parallel to those of the outlet passage. In certain preferred embodiments, "x" can be as low as zero. The low-profile design of this embodiment with substantial overlap of the inlet and outlet passage provides a compact footprint of the self-cleaning reservoir 400.

When the vacuum fan is non-operational, the suction force is no longer available in the reservoir hose, resulting in a tendency for the waste water to move in a downward direction. A substantial overlap of the inlet and outlet passages 410 and 430 may cause the waste water to flow from the outlet passage 430 to the inlet passage 410. The guide troughs 440 prevent this tendency of the flow by guiding the flow of waste water towards the fluid trap portion 420. The waste water flows downward along the walls of the guide trough, and so it does not have a clear line of sight despite a substantial overlap of the inlet and outlet passages 410 and 430. The rounded contour of the walls of the fluid trap portion 420 and the presence of the guide troughs 440 direct the waste water towards the fluid trap portion 420. Collected waste water and debris in the fluid trap portion can then be cleaned during the next use of the surface maintenance machine by the vacuum system.

Figure 14:
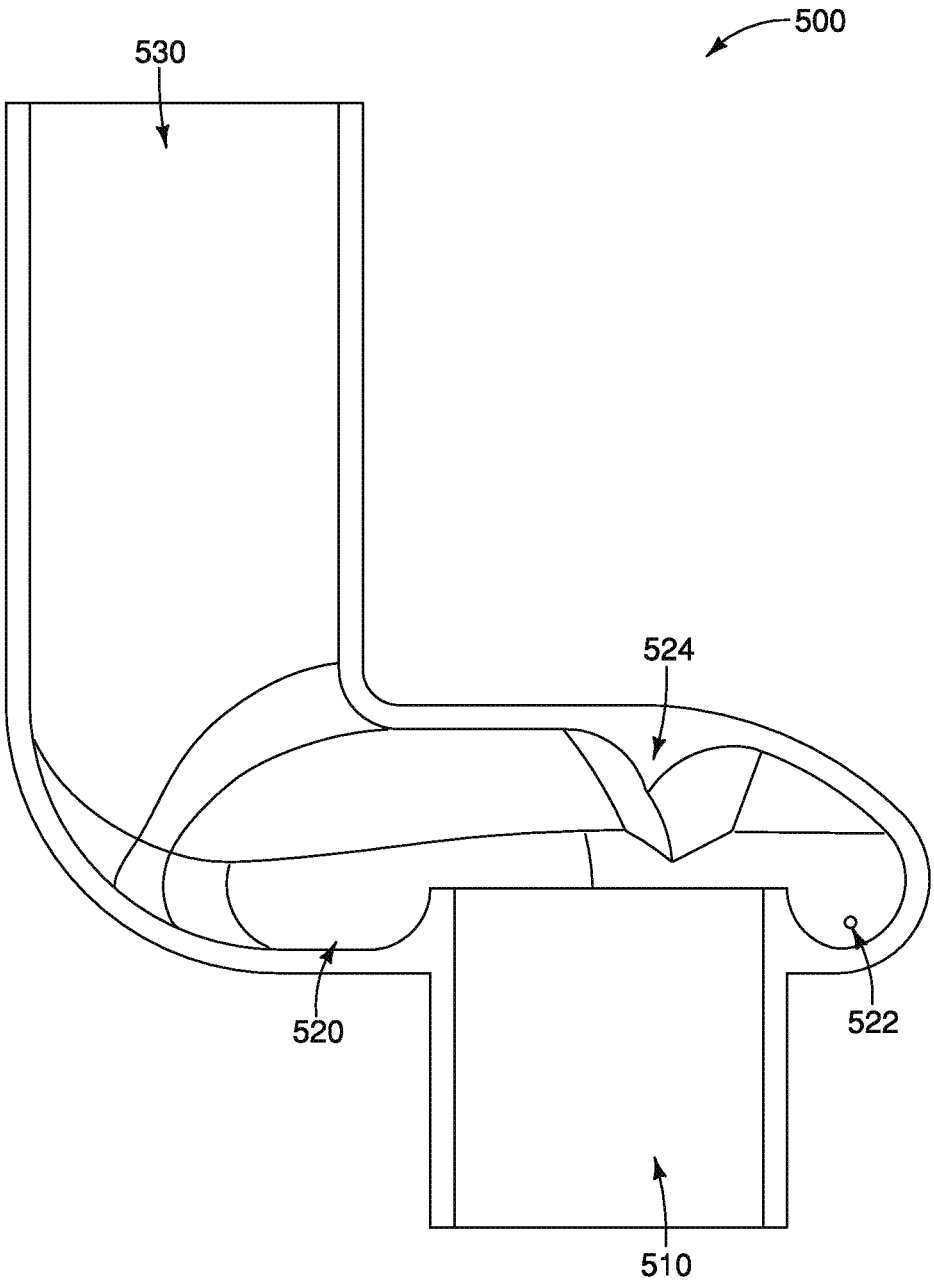
FIG. 14 is a front elevation view of a cross-section of the self-cleaning reservoir of FIG. 10.

FIGS. 10-13 show different views of a self-cleaning reservoir 500 according to another embodiment. The self-cleaning reservoir 500 includes an inlet passage 510, an outlet passage 530, a fluid trap portion 520, and a nose 522. The self-cleaning reservoir may be fabricated as a single part facilitating the assembly of the self-cleaning reservoir on to the recovery hose. The inlet and outlet passage 510 and 530 are operably coupled with a recovery hose (not shown) of a surface maintenance machine by deploying flanges, hose clamps or other similar means. The shape and size of the inlet and outlet passage 510 and 530 can be chosen to allow uniform velocity of the waste water at the inlet passage. The fluid trap portion 520 and the nose 522 have a rounded profile to avoid sharp corners for the incoming fluid, because a sharp corner causes the fluids to slow down and create a large pressure loss in the self-cleaning reservoir. The fluid trap portion 520 has a clearance "c" above the inlet passage 510. The clearance "c" allows for uniform velocity at fluids at the inlet passage 510. Some embodiments include a flow splitter 524, as shown in FIG. 14. The flow splitter can be included with the self-cleaning reservoir 400 by mechanical means, or by contouring the walls of the fluid trap portion 420 and 520. The flow splitter 524 facilitates the flow through the inlet passage 510 to be divided into two jets, a first jet away from the nose 522 and a second jet toward the nose 522.

Figure 15:
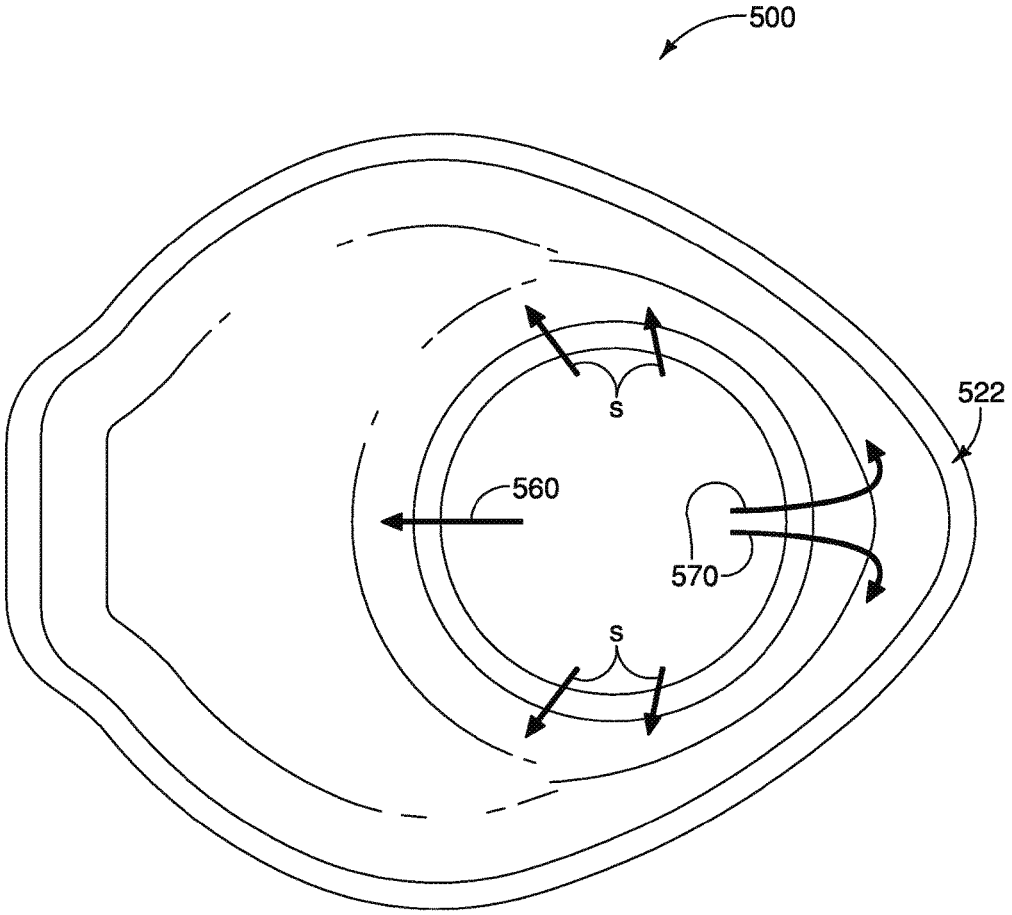
FIG. 15 is a top plan view of a cross-section of the self-cleaning reservoir of FIG. 10.
Figure 16:
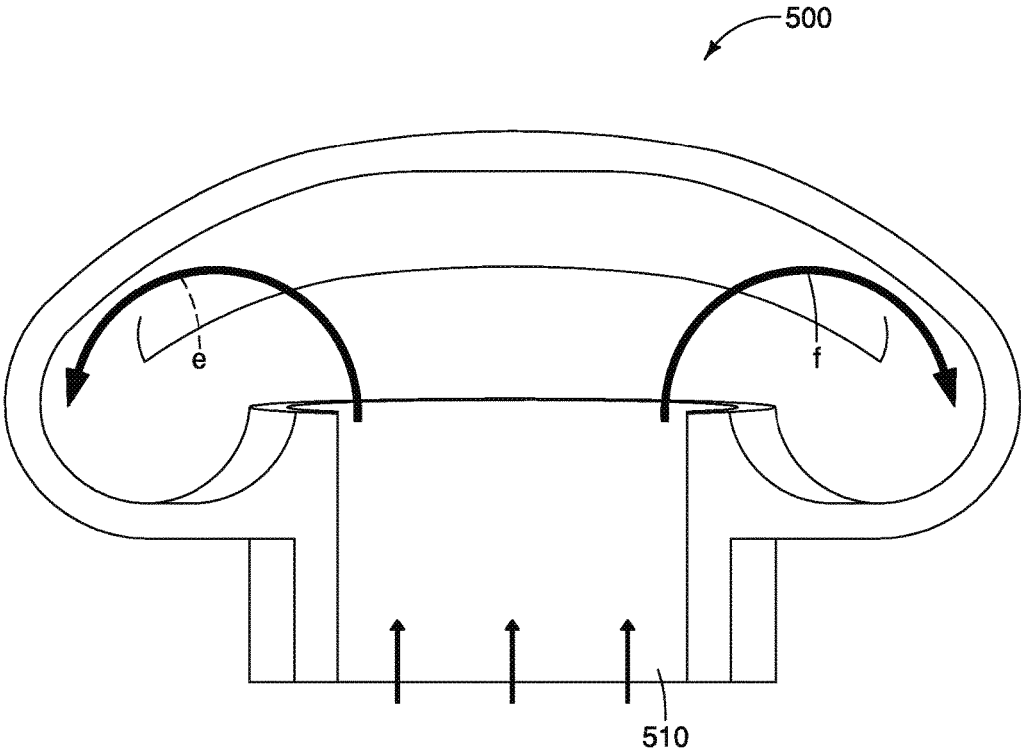
FIG. 16 is a front elevation view of a cross-section of the self-cleaning reservoir of FIG. 10.

During operation, a vacuum system is engaged to provide suction force in the recovery hose. Waste water travels through the recovery hose and enters the inlet passage 510 of the self-cleaning reservoir 500. The rounded profile of the nose 522 and fluid trap portion 520 and the flow splitter 524 acts to split the incoming fluids from the inlet passage 510 into two jets. In some other embodiments, the fluids entering the inlet passage 510 are split without the flow splitter 524. A first jet 560 comprising fluids moving away from the nose 522, and a second jet 570 comprising fluids moving toward the nose 522. The first jet 560 may additionally be split by the shape of the nose into additional secondary jets as shown in FIG. 15. Any fluid that does not move towards or away from the nose 522 in the direction of the first jet 560 and the second jet 570 flow along the sides, as indicated by arrows "s". FIG. 16 is a cross-section view of the self-cleaning reservoir 500 that shows the direction of movement of the first and second jets 560 and 570. The first and second jets 560 and 570 in this embodiment have a rotational direction "e" and "f".

Figure 17:
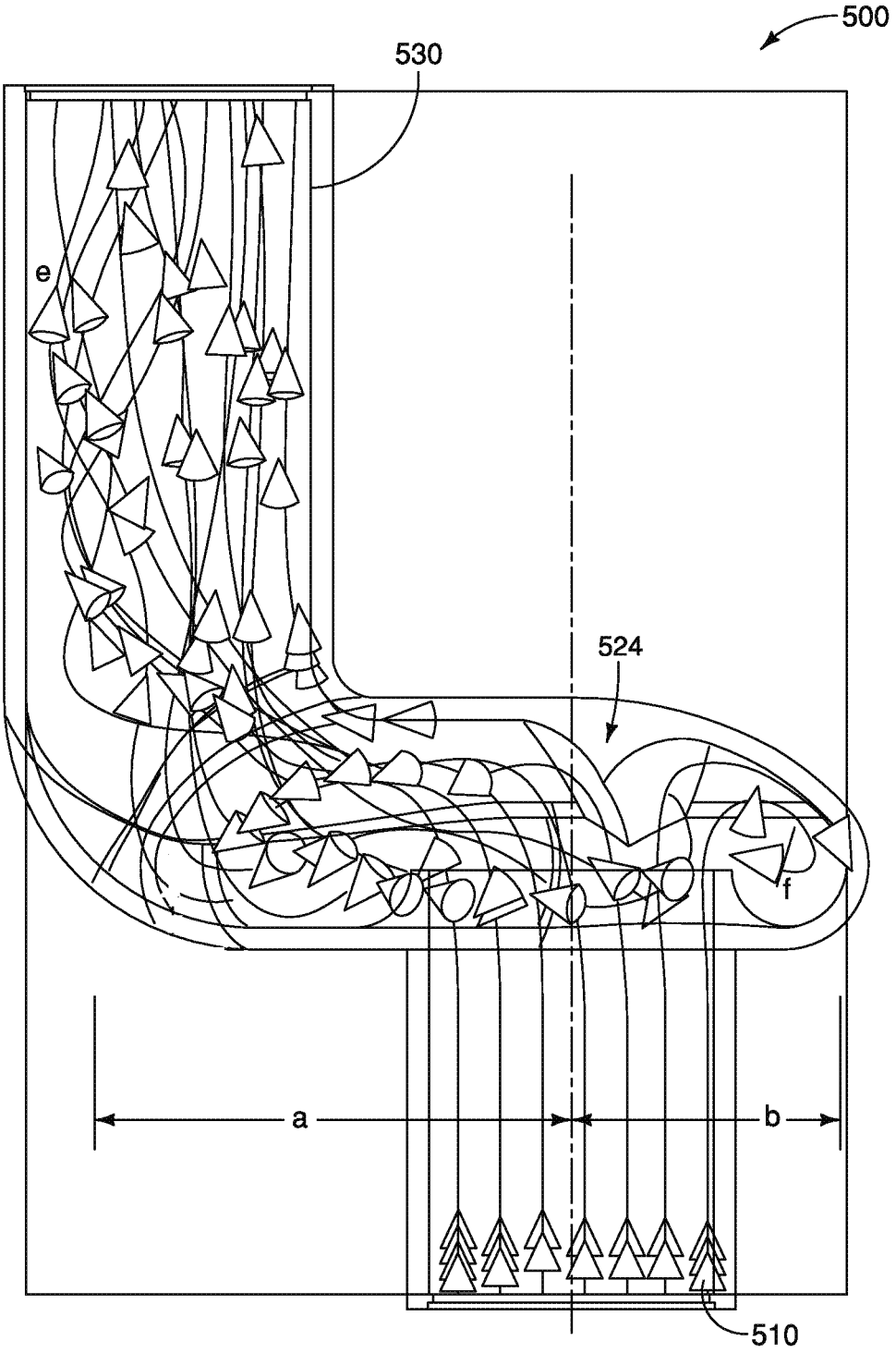
FIG. 17 is a front elevation view of a cross-section of the self-cleaning reservoir of FIG. 10 with the path of the fluids shown by arrows during operation of the vacuum system.

FIG. 17 shows the direction of movement of fluids through the self-cleaning reservoir 500. The direction of motion of the fluids is indicated by arrows, and is obtained by Computational Fluid Dynamics simulation of fluid flow through the self-cleaning reservoir 500. Fluids, such as air moving in the recovery hose due to suction, or waste water enter the inlet passage 510 of the self-cleaning reservoir 500. The inlet passage 510 is of cylindrical shape. The constant cross-sectional area, combined with a clearance "c" below the fluid trap portion 520 and the nose 522 provide allow fluids to be drawn inside the self-cleaning reservoir uniformly by applying suction force, resulting in a nearly uniform velocity of flow at inlet. The fluids travel in an upward direction through the inlet passage 510. The flow splitter 524, or the rounded shape of the fluid trap portion 520 and nose 522, or both cause the fluids from the inlet passage to be divided into the first jet 560, that moves in a first direction "e", with a first speed, and the second jet 570 that moves in a second direction "f" with a second speed. The first jet 560 does not have a substantially rotational motion, as shown in FIG. 17, because the distance between the rounded portion of the reservoir 520 and the inlet passage 510, shown by "a" in FIG. 17 is larger than the distance between the rounded portion of the nose 522 and the inlet passage 510, shown by "b" in FIG. 17. This larger distance facilitates the first jet 560 to not move in a substantially rotational direction, but rather move in a curvilinear direction "e", bend in an upward direction and move towards the outlet passage 530.

The first speed of the first jet 560 is substantially higher than the second speed of the second jet 570, because the distance "a" is larger than the distance "b". The shorter distance for the fluid to flow and the presence of the nose 522 creates an obstruction to the fluid flow path, causing the first speed of the first jet 560 to be higher than the second speed of the second jet 570. This lower value of the second speed prevents effective removal of water and debris from the nose, as fluids and debris tend to stagnate in the nose 522. The first jet 560 moves in a first direction with a first speed much larger than the second speed. As a result of higher speed of the first jet in comparison to the second jet, the fluids moving in the first direction "e" have greater momentum and bend in an upward direction and flow out of the outlet passage 530, thus emptying the self-cleaning reservoir 500.

Figure 18:
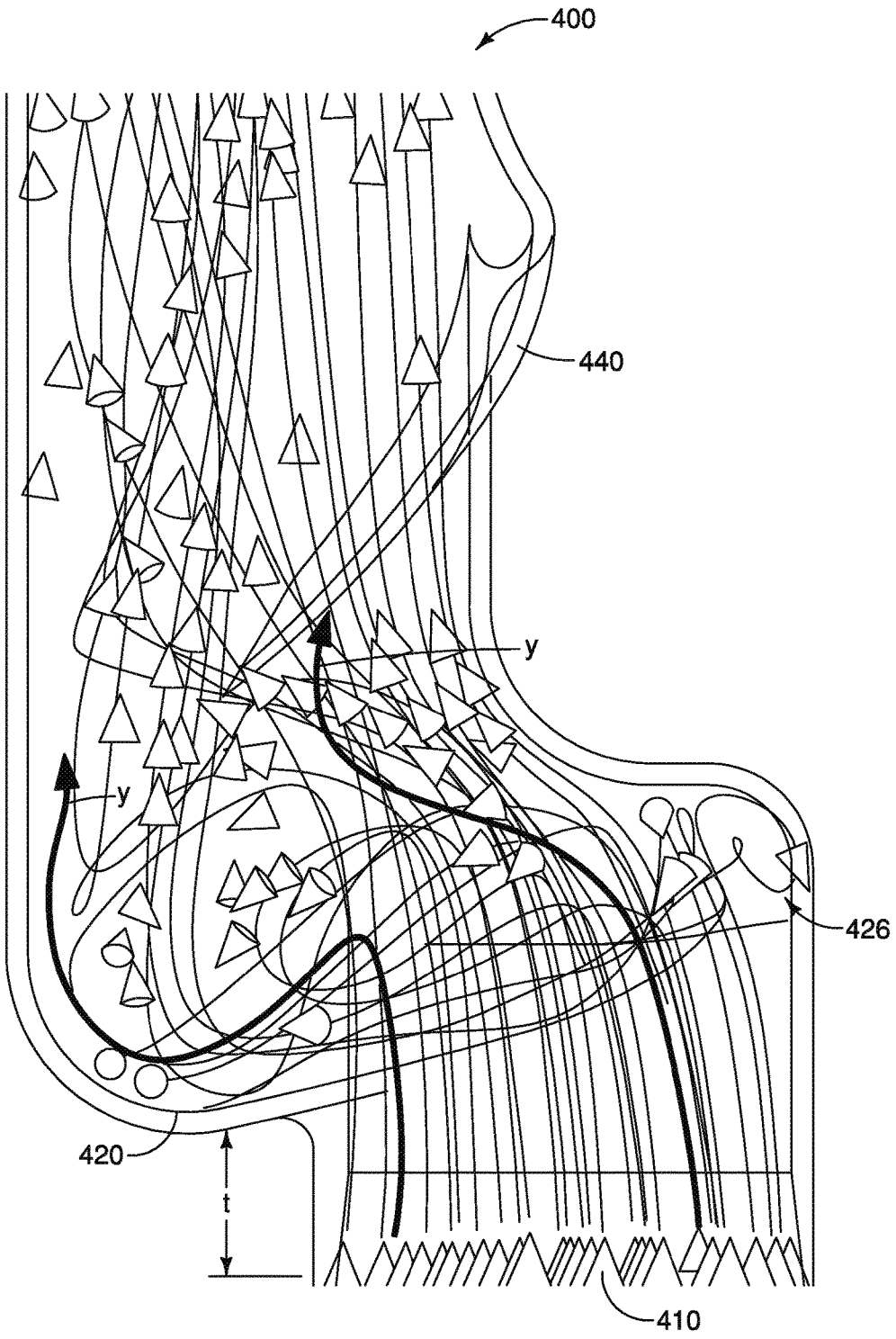
FIG. 18 is a front elevation view of a cross-section of the self-cleaning reservoir of FIG. 7 with the path of the fluids shown by arrows during operation of the vacuum system.

In some preferred embodiments, such as the self-cleaning reservoir 400, the nose is eliminated to facilitate better removal of waste water and debris. FIG. 18 shows the path of fluids through the self-cleaning reservoir 400. The direction of motion of the fluids is indicated by arrows, and is obtained by Computational Fluid Dynamics simulation of fluid flow through the self-cleaning reservoir 400. Fluids, such as waste water or air from suction of the vacuum fan flow through the inlet passage 410 of the self-cleaning reservoir 400. The rounded shape of the fluid trap portion 420 and the clearance "t" below the fluid trap portion 420, draw the fluid in an upward direction uniformly by eliminating a sharp corner for the fluid from the inlet passage. As the fluids move upwards into the fluid trap portion, the rounded shape of the fluid trap portion 420 causes the fluids to move in a curvilinear direction "y". The fluid stream substantially conforms to the shape of the fluid trap portion 420. The curved section 426 of the fluid trap portion 420 causes any fluid in this region to move with a velocity much lower than the velocity of the fluids at inlet passage 420. As a result, some of the waste water and debris may not have a tendency to move upwards towards the outlet passage 430. Any waste water and debris that do not move out of the curved section 426 fall back into the inlet passage 410, where they are pushed by the incoming stream of air from the suction caused by the vacuum fan and move upwards towards the outlet passage, thus precluding the need to manually empty the self-cleaning reservoir to remove accumulated waste water and debris.

Figure 19:
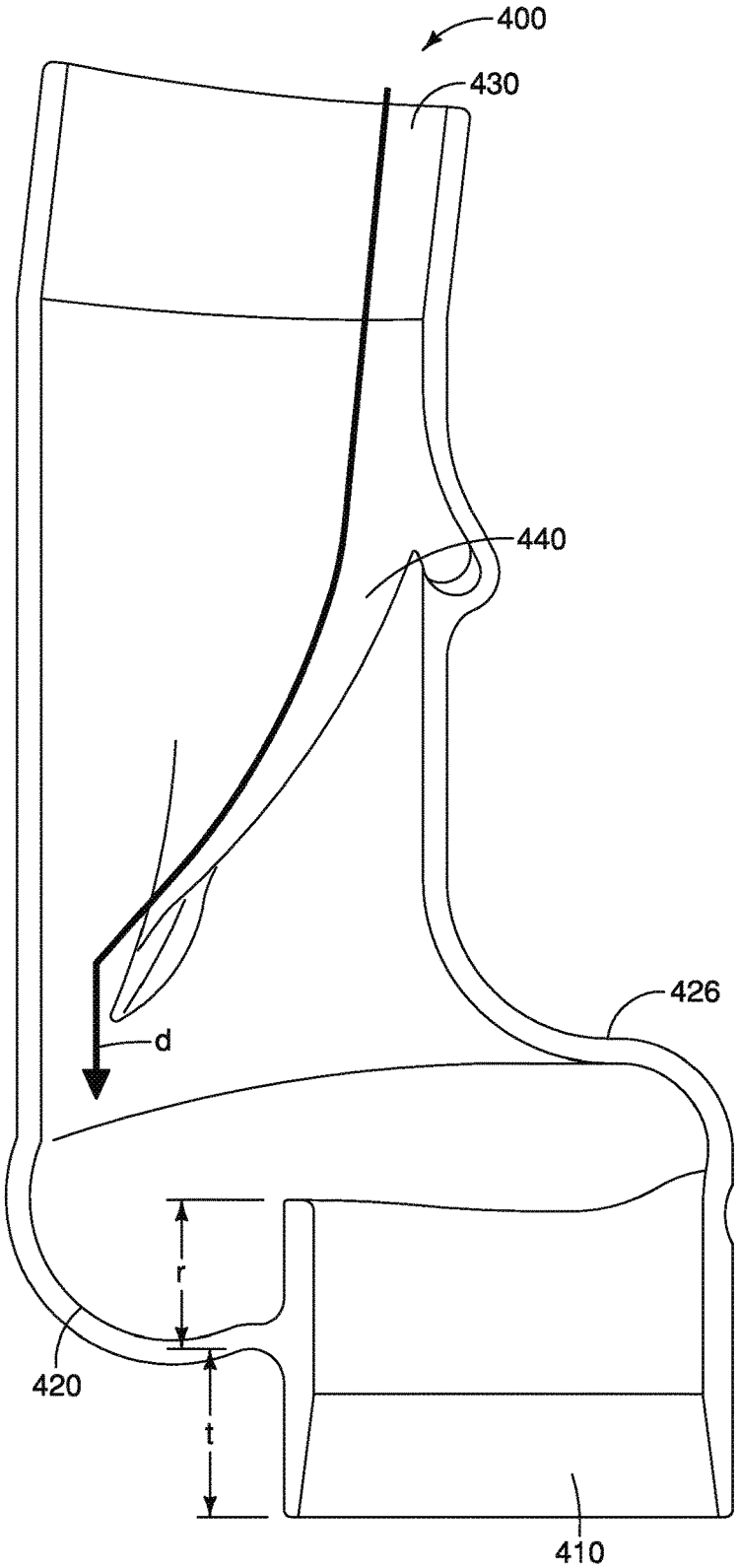
FIG. 19 is a front elevation view of a cross-section of the self-cleaning reservoir of FIG. 7 with the path of the waste water shown by arrow when the vacuum system is not in operation.
Figure 20:
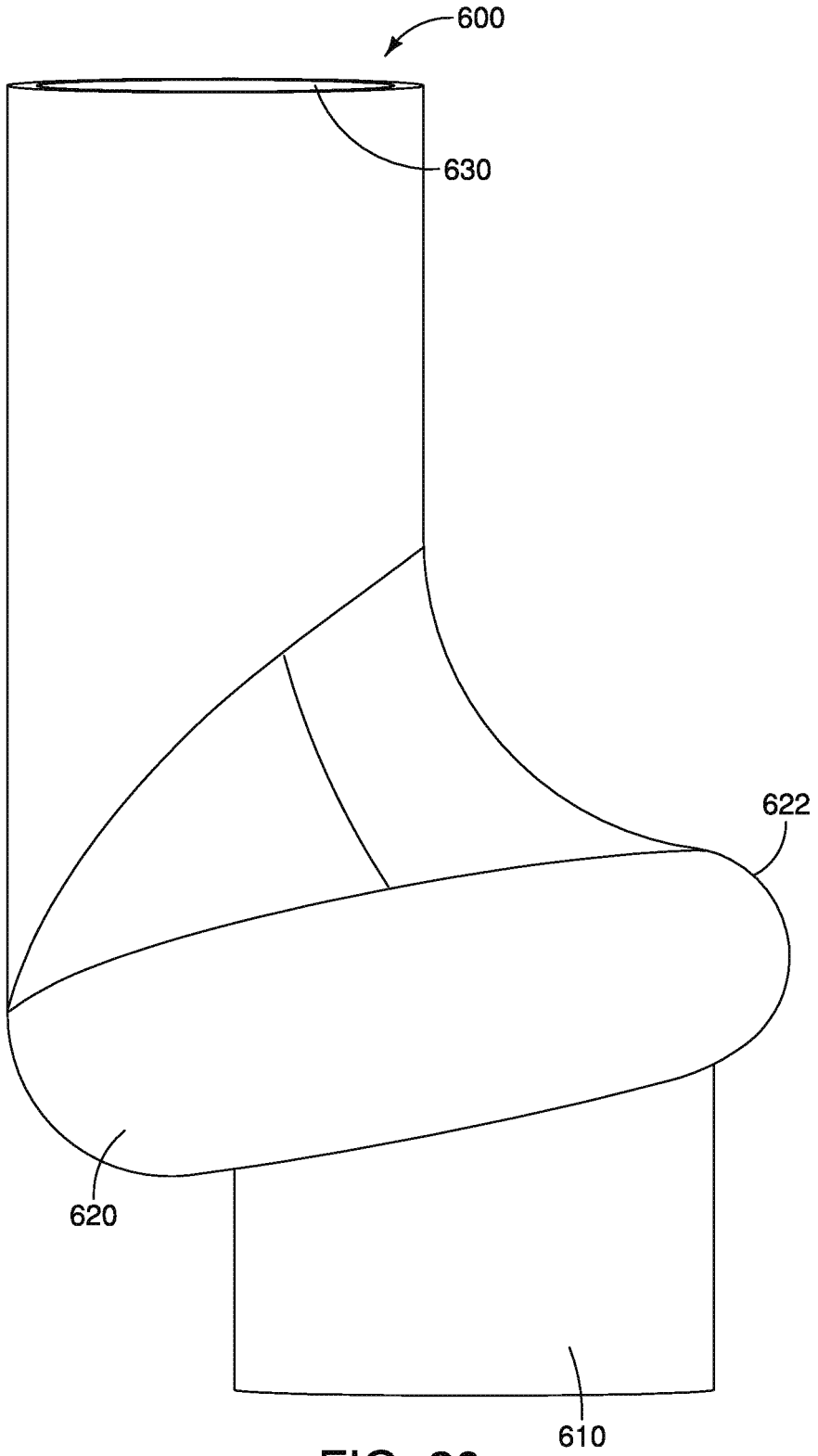
FIG. 20 is a front elevation view of a portion of an embodiment of the self-cleaning reservoir of the present invention.

When the vacuum system is not operational, any waste water and debris that has not been drawn into the recovery tank travels in a downward direction, assisted by gravitational force through the recovery hose, and into the outlet passage 430 of the self-cleaning reservoir 400. The guide troughs 440 are contoured with a relatively large radius of curvature relative to the cross-section of the volume of suctioned fluid flow. If the quantity of water and debris that fall in a downward direction is not substantially large relative to the volume of suctioned fluid flow, the waste water and debris follow a curvilinear path of motion as indicated by "d" in FIG. 19, the curvilinear path of motion conforming to the contour of the guide trough due to a phenomenon known as Coanda effect.

Figure 21:
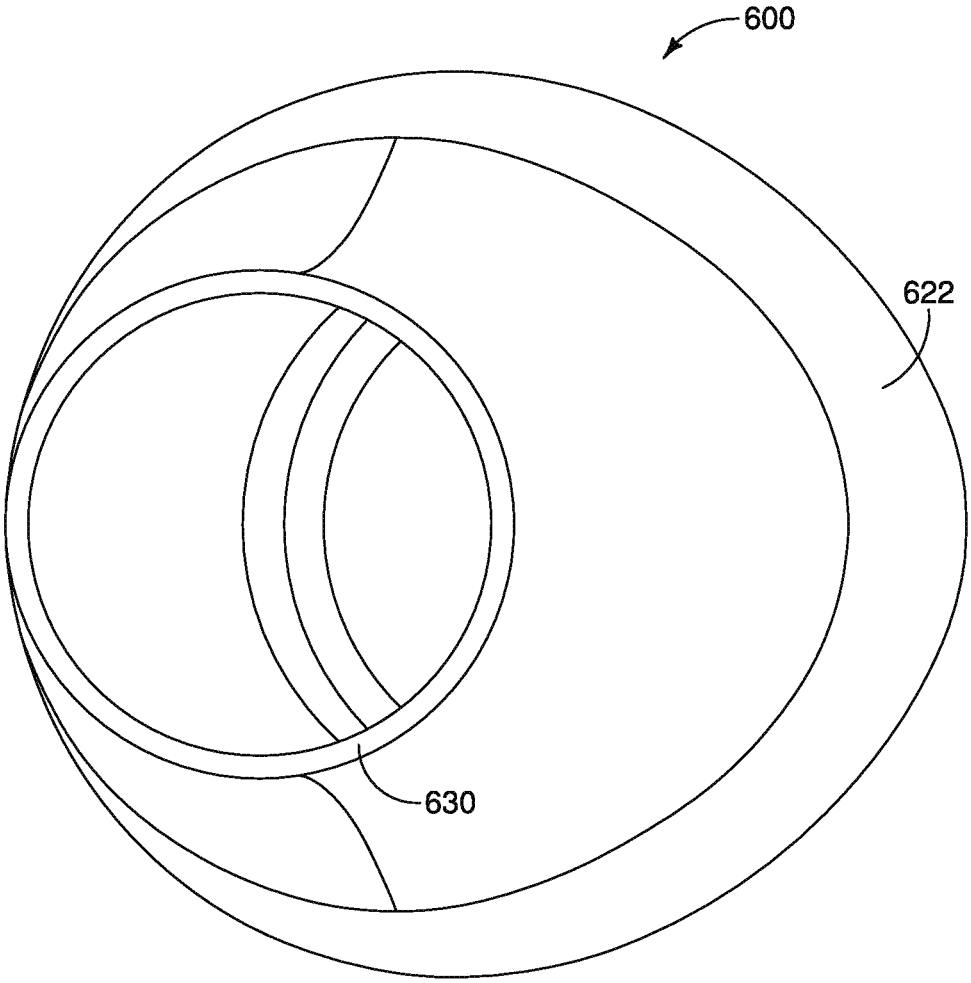
FIG. 21 is a top plan view a portion of the self-cleaning reservoir of FIG. 20.
Figure 22:
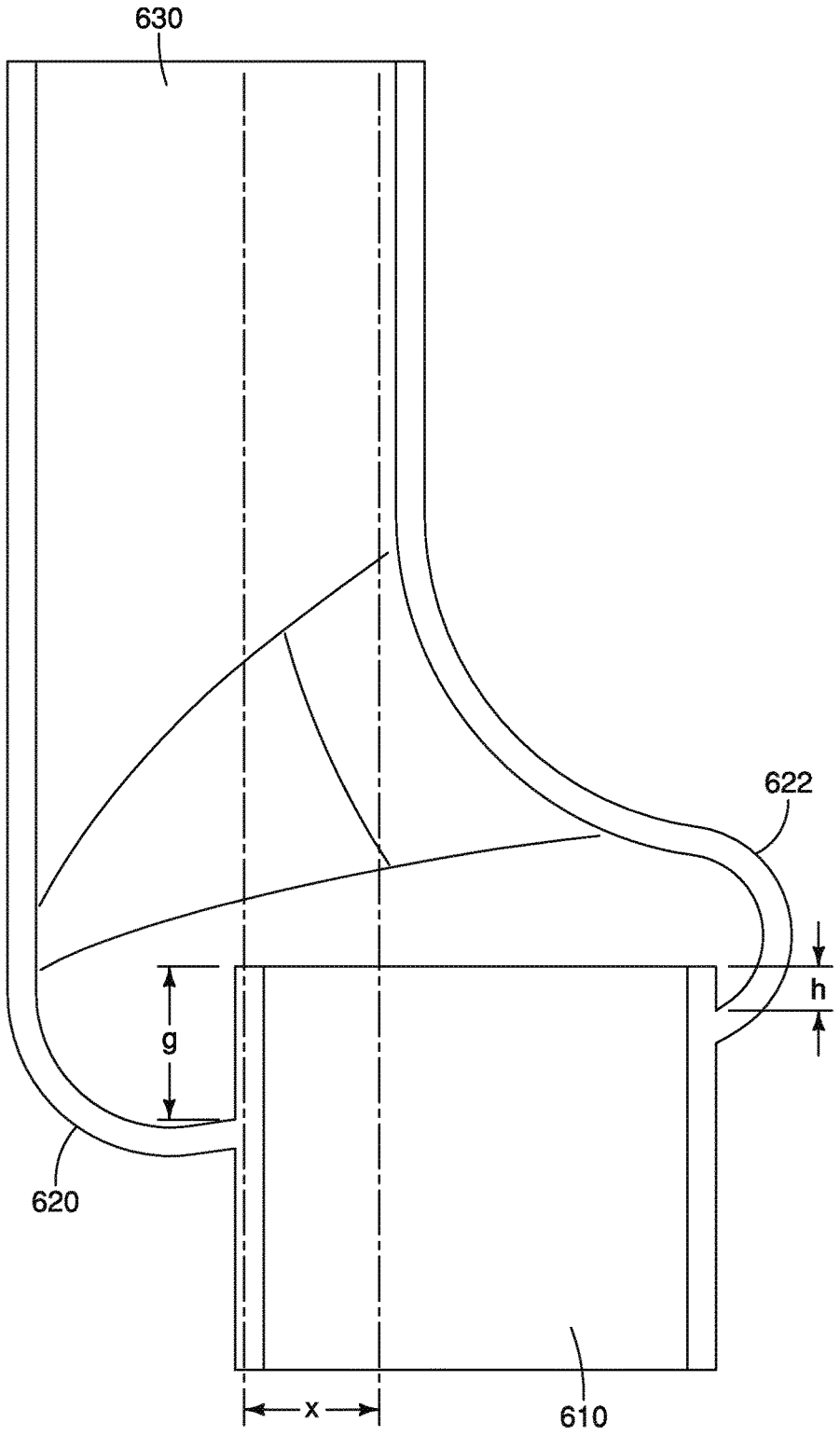
FIG. 22 is a front elevation view of a cross-section of the self-cleaning reservoir of FIG. 20.

FIGS. 20-24 illustrate alternate embodiments of the self-cleaning reservoir 600. In this embodiment, the self-cleaning reservoir 600 includes an inlet passage 610, an outlet passage 630, a nose 622 and a fluid trap portion 620. The self-cleaning reservoir may be fabricated as a single part facilitating the assembly of the self-cleaning reservoir on to the recovery hose. As shown in FIGS. 21 and 22, the inlet and outlet passages have an overlap distance "x". The overlap "x" is the distance between the walls of the inlet and the outlet passages 610 and 630. In some preferred embodiments, the overlap distance "x" can be zero, implying that the inlet and outlet passages 610, 630 do not have a line of sight. The inlet passage 610 extends a distance "g" into the fluid trap portion 620, to form a barrier between the fluid trap portion 620 and the inlet passage 610 to prevent the fluids collected in the fluid trap portion from flowing outwardly to the inlet passage 610. The fluid trap portion 620 has a rounded profile to avoid a sharp corner against which fluids from the inlet passage 610 may slow down.

Figure 23:
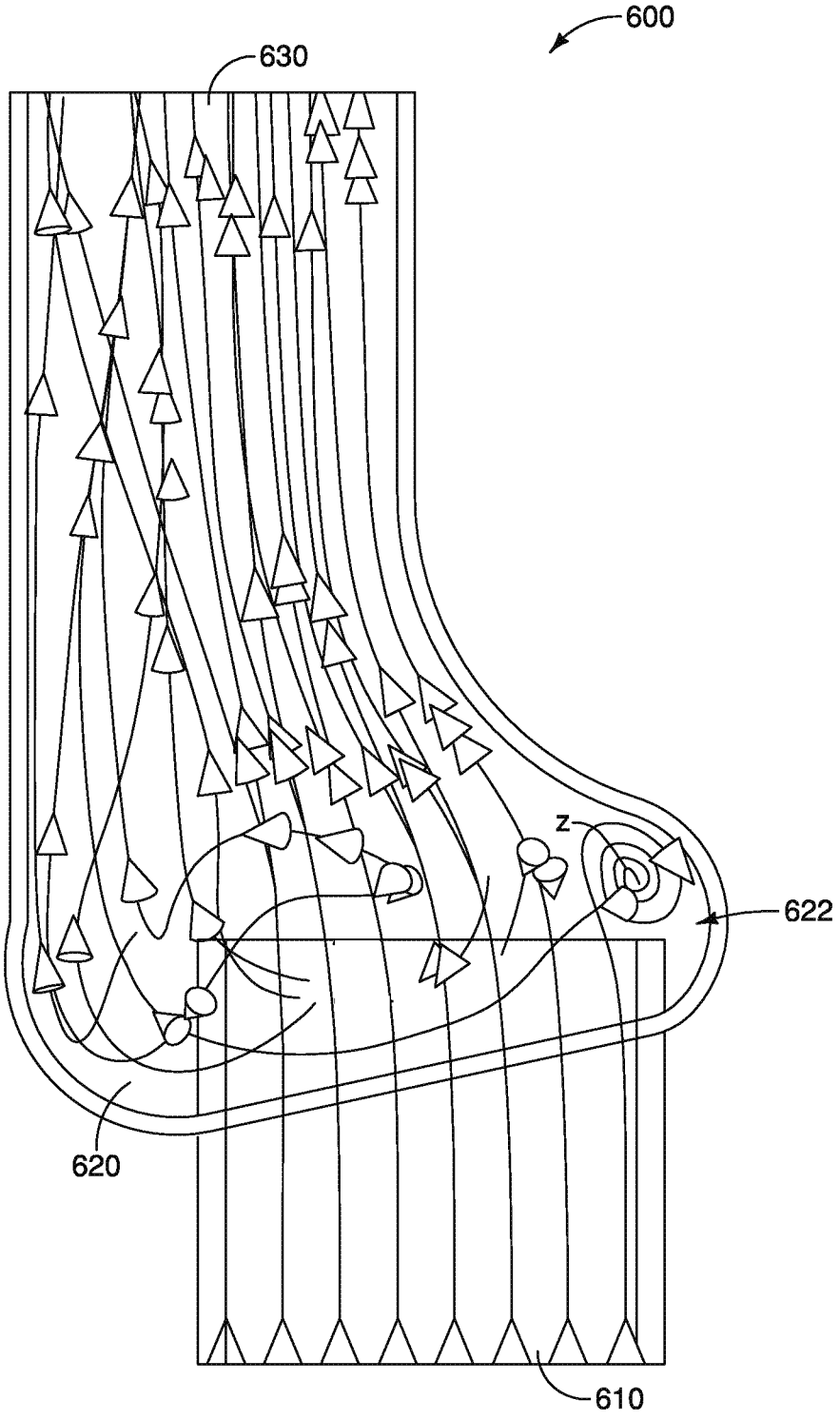
FIG. 23 is a front elevation view of a cross-section of the self-cleaning reservoir of FIG. 20 with the path of the fluids shown by arrows during operation of the vacuum system.
Figure 24:
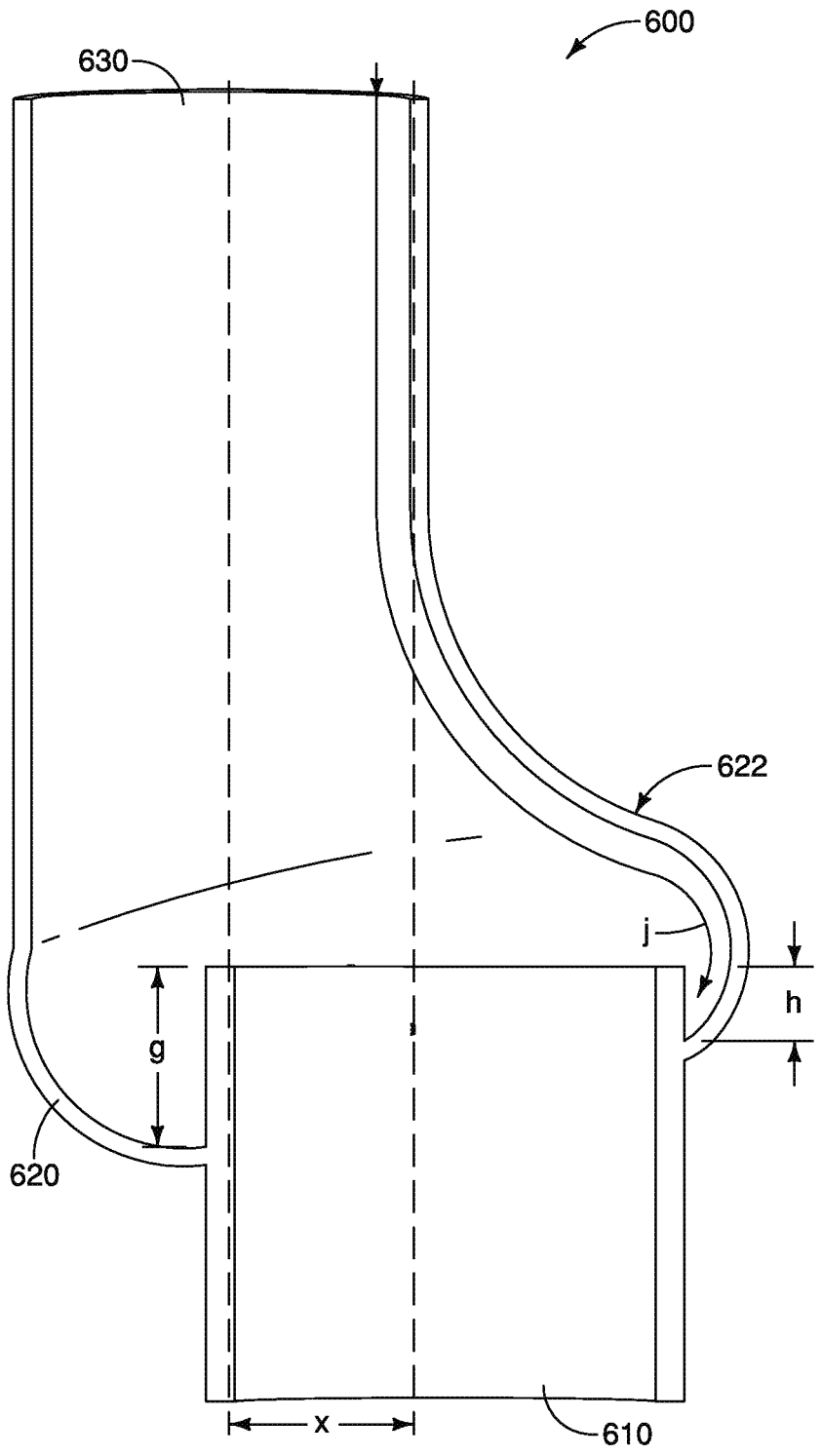
FIG. 24 is a front elevation view of a cross-section of the self-cleaning reservoir of FIG. 20 with the path of the waste water shown by arrow when the vacuum system is not in operation.

FIG. 23 shows the direction of movement of fluids through the self-cleaning reservoir 600. The direction of motion of the fluids is indicated by arrows, and is obtained by Computational Fluid Dynamics simulation of fluid flow through the self-cleaning reservoir 600. When the vacuum system is operational, waste water and debris travel upwards through the inlet passage 610. The rounded shape of the fluid trap portion 620 allows the waste water and debris to move in a curvilinear path as indicated in FIG. 23. The rounded shape of the nose 622 and its proximity to the inlet passage 610 defined by distance "h" introduces motion of waste water and debris in a rotational direction "z" as indicated by the arrows at velocities much lower than the velocity of waste water at inlet and outlet passages 610 and 630. As a consequence, waste water and debris tend to stagnate at the nose 622. When the vacuum system is not operational, waste water and debris from the outlet passage 630 flow towards the nose 622 along a curvilinear path indicated by the arrow "j" in FIG. 24, the curvilinear path conforming to the contour of the self-cleaning reservoir 600 due to a phenomenon known as Coanda effect.

Figure 25:
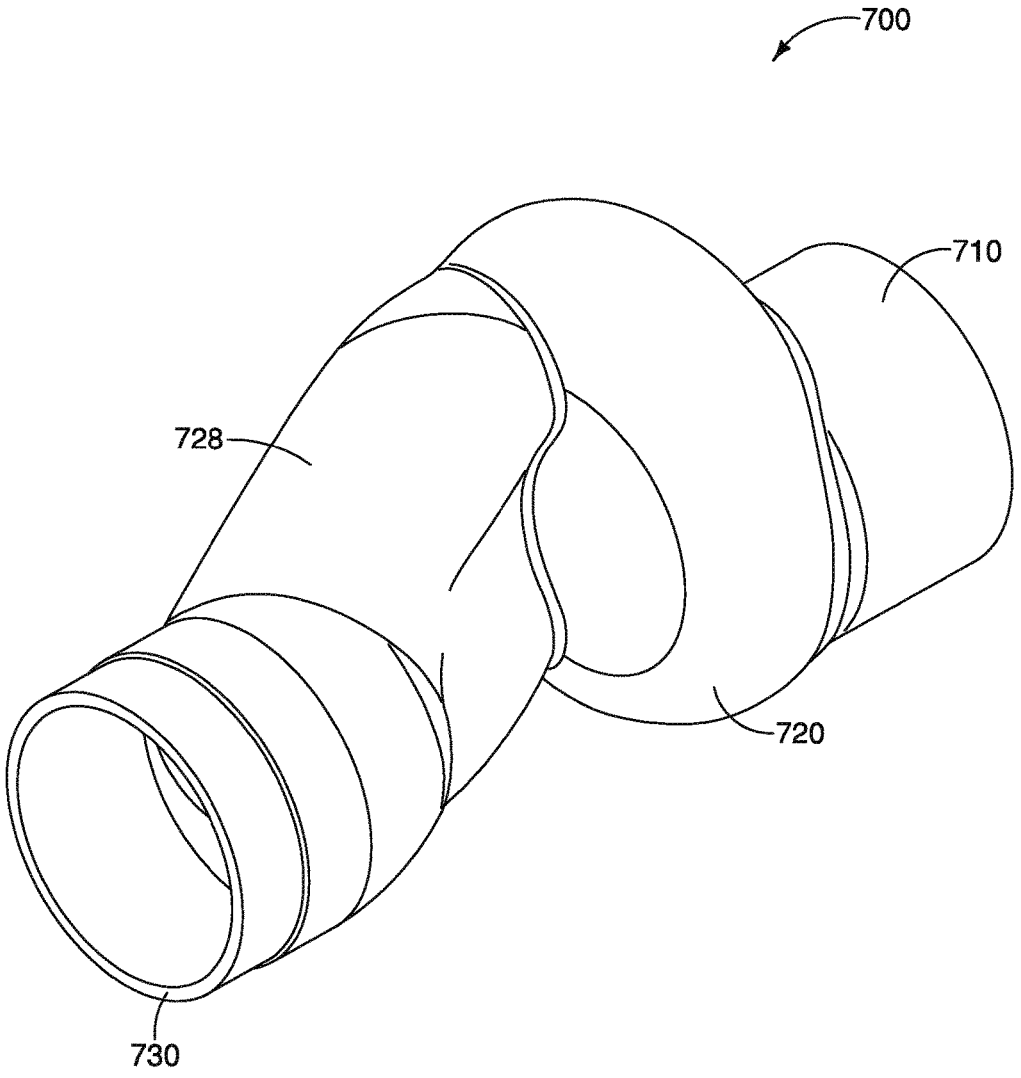
FIG. 25 is an upper perspective view of a portion of another embodiment of the self-cleaning reservoir of the present invention.
Figure 26:
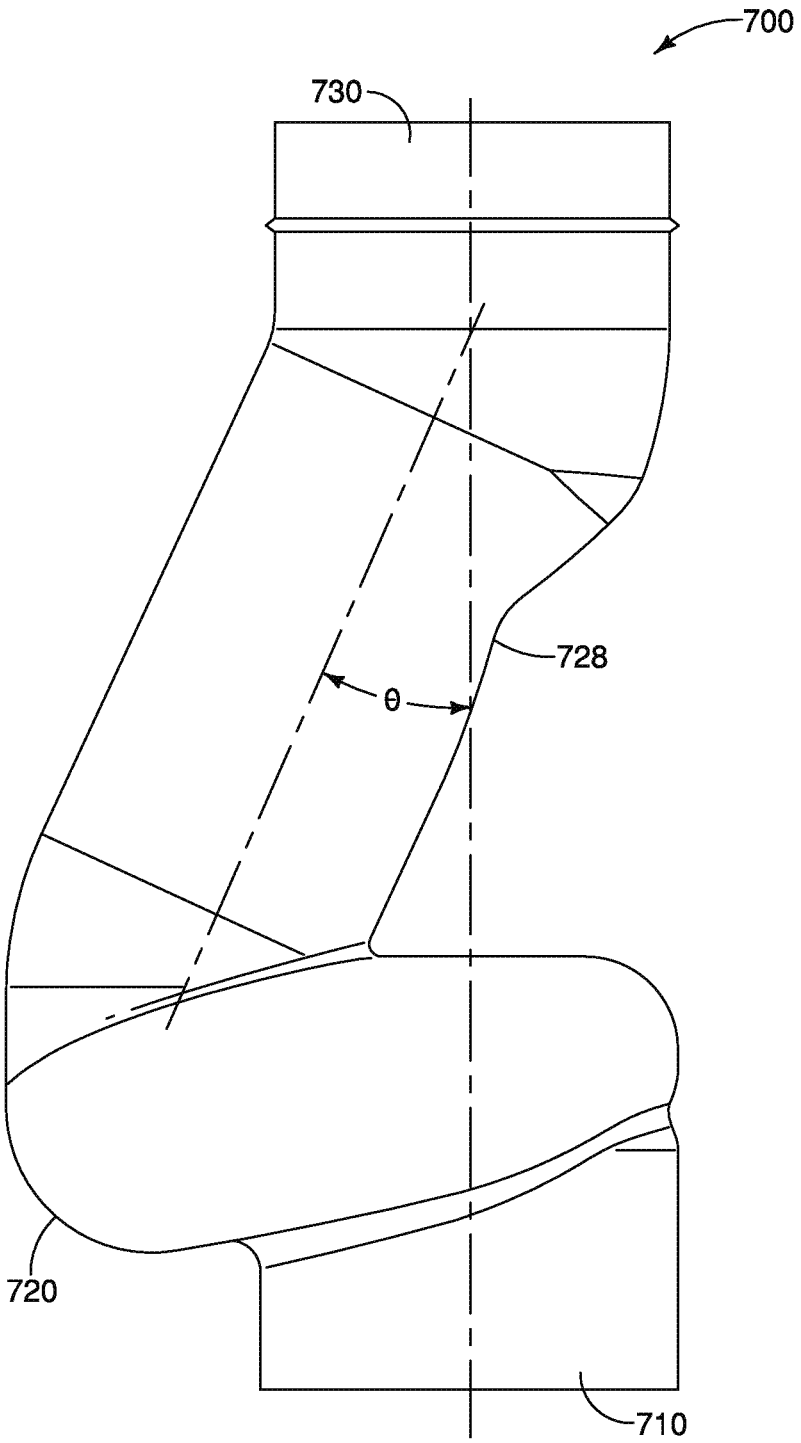
FIG. 26 is a front elevation view of a portion of the self-cleaning reservoir of FIG. 25.
Figure 27:
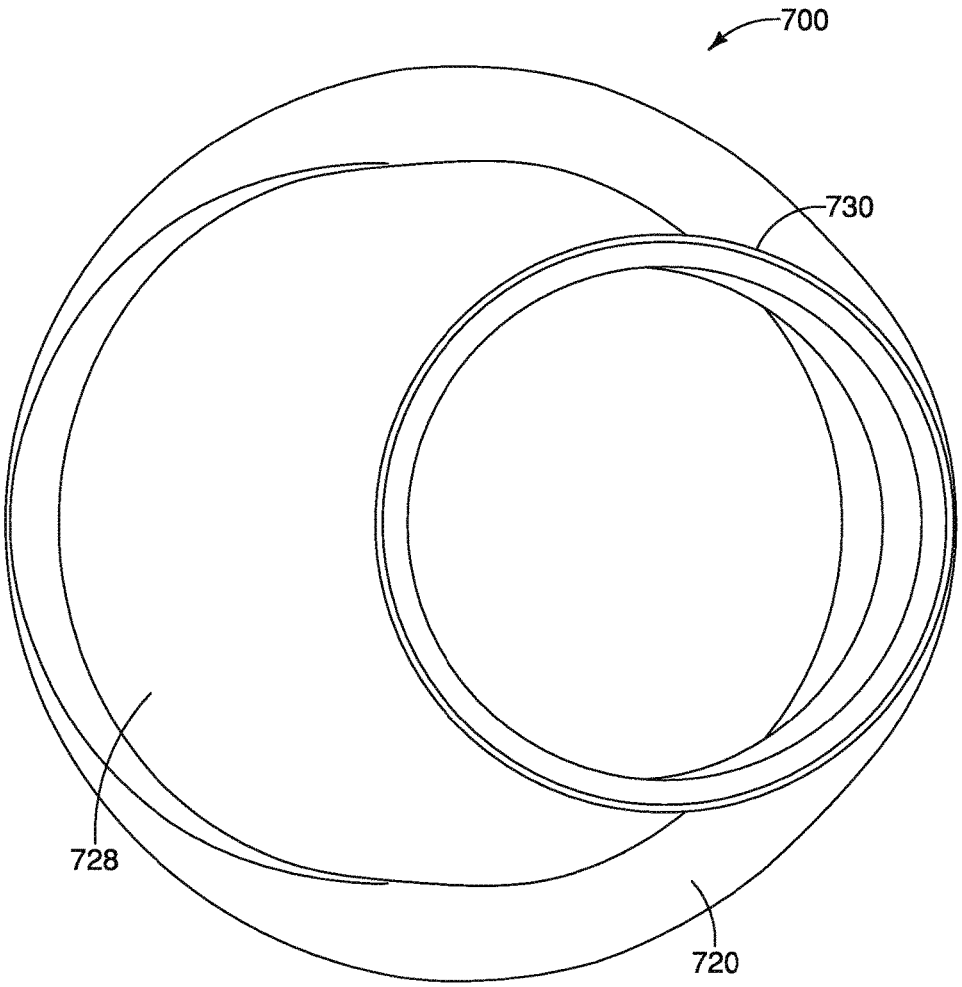
FIG. 27 is a top plan view of a portion of the self-cleaning reservoir of FIG. 25.

FIGS. 25-27 show the self-cleaning reservoir 700 according to another embodiment. In this embodiment, the self-cleaning reservoir comprises an inlet passage 710, a fluid trap portion 720, an inclined portion 728 and an outlet passage 730. The self-cleaning reservoir may be fabricated as a single part facilitating the assembly of the self-cleaning reservoir on to the recovery hose. The fluid trap portion has a rounded profile to allow uniform velocity at the inlet passage 710 by eliminating sharp corners and accompanying pressure losses in the self-cleaning reservoir. The inlet and outlet passages are shown having circular cross-section, and have a common axis. The overlap of the inlet and outlet passages is substantial, but waste water and debris do not have a line of sight as illustrated in FIG. 27. The angle of inclination of the inclined portion with respect to the vertical axis is indicated by "θ" in FIG. 26. Waste water and debris will flow from the outlet passage 730, along the walls of the inclined portion 728 and into the fluid trap portion 720 when the vacuum system is not operational. Increasing the angle of inclination θ of the inclined portion from the vertical direction increases the likelihood of waste water and debris collecting in the fluid trap portion 720, rather than flowing from the outlet passage 730 to the inlet passage 710.

Figure 28:
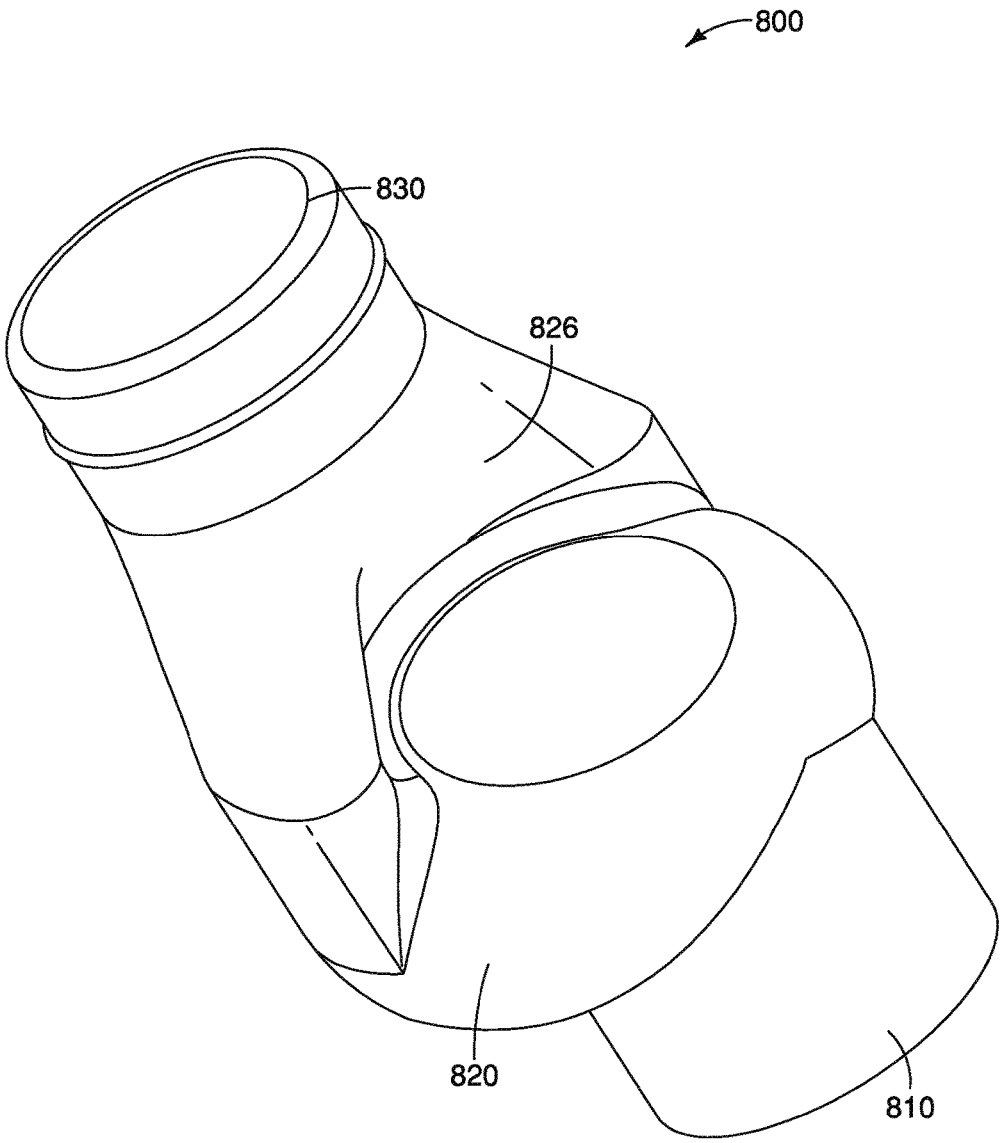
FIG. 28 is an upper perspective view of a portion of another embodiment of the self-cleaning reservoir of the present invention.
Figure 29:
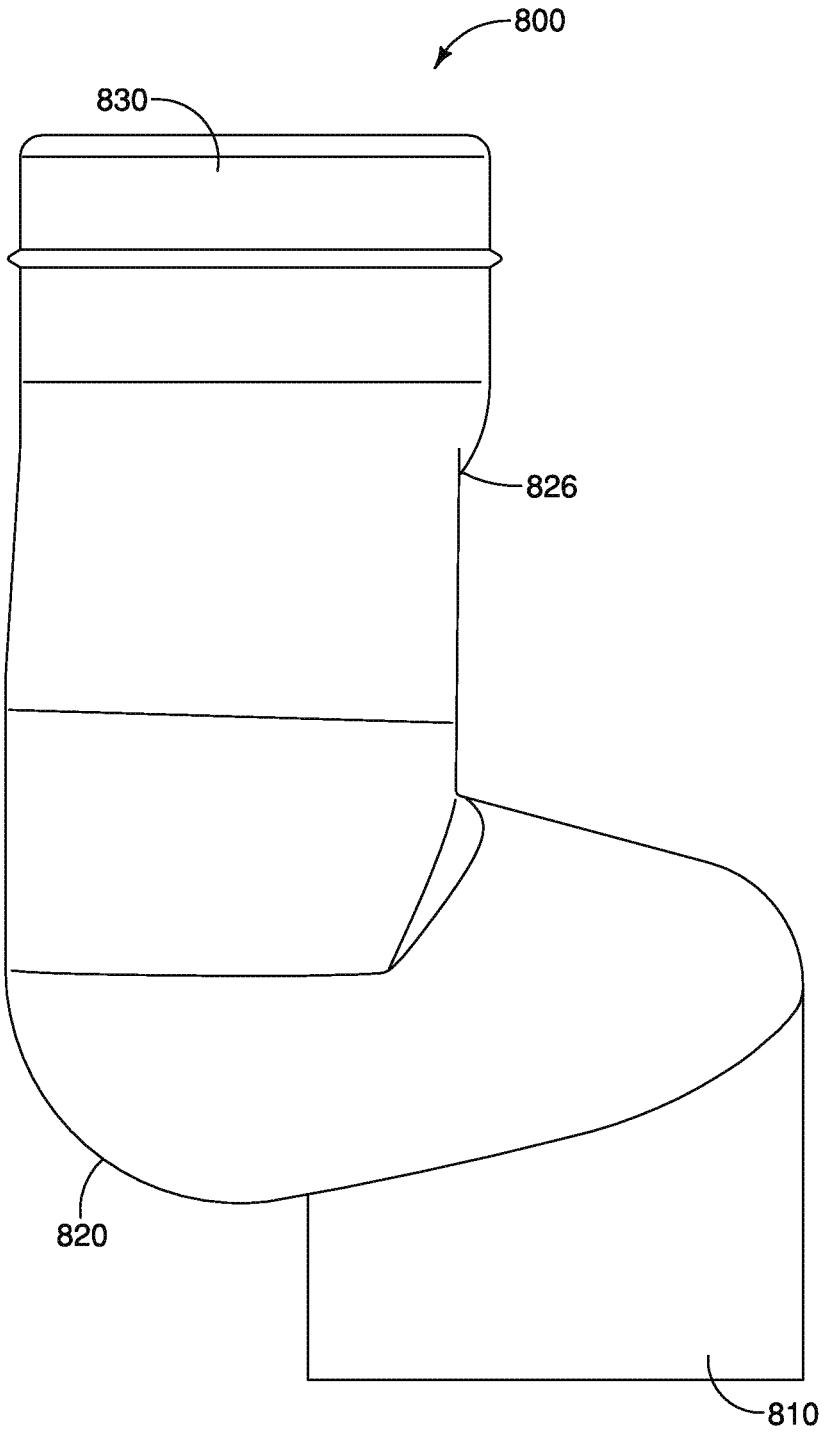
FIG. 29 is a front elevation view of a portion of the self-cleaning reservoir of FIG. 28.
Figure 30:
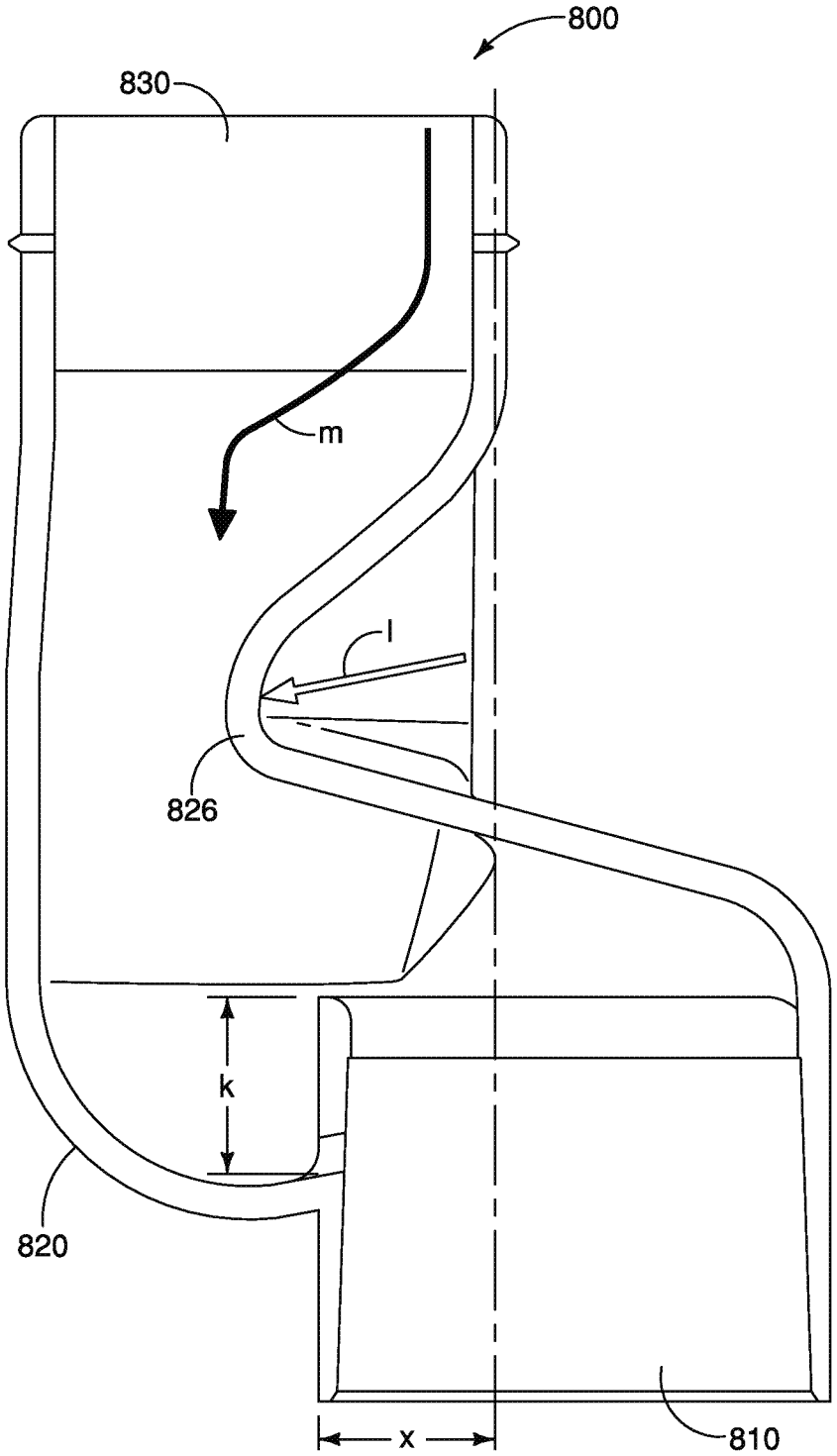
FIG. 30 is a front elevation view of a cross-section of the self-cleaning reservoir of FIG. 28.

FIGS. 28-30 illustrate the self-cleaning reservoir 800 according to another embodiment. The self-cleaning reservoir comprises an inlet passage 810, an outlet passage 830, a fluid trap portion 820 and an indentation 826. The self-cleaning reservoir may be fabricated as a single part facilitating the assembly of the self-cleaning reservoir on to the recovery hose. The recovery hose may be coupled to a vacuum system with a vacuum fan that draws waste water and debris into the inlet passage 810. The inlet passage 810 and the outlet passage 830 overlap. A distance "x" indicates the extent of the overlap of the inlet and outlet passages 810 and 830. The walls of the inlet passage 810 extends a distance "k" into the fluid trap portion to form a barrier that prevents waste water and debris contained in the fluid trap portion 820 from flowing outwardly into the inlet passage 810. The indentation is characterized by a radius of curvature "l". The rounded shape of the fluid trap portion 820 avoids a sharp corner for the fluids flowing into the fluid trap portion and introduces a curvilinear path for the waste water from the inlet passage to the outlet passage. The indentation 826 causes waste water pressure at the outlet passage 830 to be lower than that at the inlet passage 810. When the vacuum system is not operational, water from the outlet passage 830 follows the contour of the self-cleaning reservoir. The indentation 826 introduces a curvilinear path as indicated by the direction "m" in FIG. 30 because of the radius of curvature "l", causing the waste water to collect in the fluid trap portion 820. A larger radius of curvature "l" translates to a greater likelihood for the waste water to flow into the fluid trap portion 820.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A fluid recovery system for a floor surface maintenance machine, comprising:
- a squeegee assembly adapted to engage the floor surface;
- a vacuum system operably coupled to the squeegee assembly, the vacuum system applying a suction force on fluids on the floor surface;
- a fluid suction path extending from the squeegee assembly to a fluid recovery tank, the fluid suction path operably coupled to the vacuum system such that the vacuum system draws fluids from the floor surface through the fluid suction path due to the suction force;
- a recovery hose forming part of the fluid suction path and leading to the fluid recovery tank;
- a reservoir forming part of the fluid suction path and operably coupled to the recovery hose, the reservoir being a single monolithic part, the reservoir comprising:
  - an inlet passage having a vertical portion, the vertical portion being generally perpendicular to the floor surface,
  - an outlet passage operably connected and leading to the recovery hose the outlet passage having a vertical portion generally parallel to the vertical portion of the inlet passage, and
  - a fluid trap portion positioned between the inlet and outlet passages, the fluid trap portion being directly connected to the vertical portion of the inlet passage and the vertical portion of the outlet passage,
  - the vertical portion of the outlet passage being positioned vertically above the fluid trap portion,
  - the fluid trap portion being positioned vertically above the vertical portion of the inlet passage,
  - the reservoir permitting passage therethrough of fluids suctioned by the vacuum system from the floor to the recovery hose,
  - the fluid trap portion trapping a backflow of fluids from the recovery hose in the fluid trap portion when the vacuum system stops suctioning fluids from the floor to the recovery hose,
  - the reservoir shaped to be generally self-cleaning such that the reservoir clears most fluids trapped in the fluid trap portion when the vacuum system starts suctioning fluids from the floor to the recovery hose.

2. The fluid recovery system of claim 1, wherein the fluid trap portion has a rounded shape, the rounded shape of the fluid trap portion causing fluids in the recovery hose to be drawn inside the reservoir with a generally uniform velocity at the inlet passage.

3. The fluid recovery system of claim 1, wherein the inlet and outlet passages overlap at least partially with respect to each other in an axial direction to form an overlapping portion, the walls of the inlet and outlet passages being offset from each other by an overlap distance.

4. The fluid recovery system of claim 3, wherein the overlap distance is approximately zero.

5. The fluid recovery system of claim 3, wherein an inlet of the inlet passage is at a clearance distance from the fluid trap portion along an inlet flow direction, the clearance distance causing the fluids to be drawn into the reservoir with a uniform velocity at the inlet.

6. The fluid recovery system of claim 3, wherein the reservoir includes at least one guide trough, the guide trough positioned between fluid trap portion and the outlet passage, the guide trough adapted to direct fluids from the outlet passage towards the fluid trap portion when the vacuum system does not draw fluids from the floor surface.

7. The fluid recovery system of claim 3, wherein the reservoir includes an inclined portion, the inclined portion disposed between the inlet passage and the outlet passage about an inclination axis, the inclination axis disposed at a non-zero angle from the first axis of the inlet passage, the inclined portion causing fluids from the outlet passage to flow at a direction parallel to the inclination axis and collect in the fluid trap portion when the vacuum system does not draw fluids from the floor surface.

8. The fluid recovery system of claim 1, wherein the reservoir includes a flow splitter, the flow splitter being positioned between the inlet passage and the reservoir, the flow splitter adapted to divide the fluids drawn inside the recovery hose into two jets of fluids moving in opposite directions inside the reservoir.

9. The fluid recovery system of claim 1, wherein the reservoir includes an indentation, the indentation being defined by an inwardly curved surface with a radius of indentation, the indentation extending radially inwardly into the outlet passage, the indentation causing fluids from the outlet passage to flow along the inwardly curved portion and collect in the fluid trap portion when the vacuum system does not draw fluids from the floor surface.

10. The fluid recovery system of claim 1, wherein the reservoir connects directly to the squeegee assembly.

11. The fluid recovery system of claim 1, wherein the recovery hose connects between the reservoir and the fluid recovery tank.

12. The fluid recovery system of claim 1, wherein the reservoir is shaped to be self-cleaning such that the reservoir clears fluids trapped in the fluid trap portion when the vacuum system starts suctioning fluids from the floor to the recovery hose.

13. The fluid recovery system of claim 1, wherein the fluid trap portion has a rounded portion that assists in clearing fluids trapped in the fluid trap portion when the vacuum system starts suctioning fluids from the floor to the recovery hose.

14. The fluid recovery system of claim 1, wherein the fluid trap portion comprises a vertical portion generally parallel to the vertical portion of the outlet passage, the vertical portion of the fluid trap portion being directly coupled to the vertical portion of the outlet passage.

15. The fluid recovery system of claim 1, wherein the inlet passage extends toward the fluid trap portion so as to form a barrier in the fluid trap portion to prevent the waste trapped in the fluid trap portion from flowing into the inlet passage.

16. A floor surface maintenance machine with a fluid recovery system, comprising:

a frame operably supporting wheels and a scrub head, a squeegee assembly supported by the frame and adapted to engage the floor surface;

a vacuum system supported by the frame and operably coupled to the squeegee assembly, the vacuum system applying a suction force on fluids on the floor surface;

a fluid suction path extending from the squeegee assembly to a fluid recovery tank, the fluid suction path operably coupled to the vacuum system such that the vacuum system draws fluids from the floor surface through the fluid suction path due to the suction force;

a recovery hose forming part of the fluid suction path and leading to the fluid recovery tank;

a reservoir forming part of the fluid suction path and operably coupled to the recovery hose, the reservoir being a single monolithic part, the reservoir comprising:

an inlet passage, having a vertical portion, the vertical portion being generally perpendicular to the floor surface, an outlet passage operably connected and leading to the recovery hose the outlet passage having a vertical portion generally parallel to the vertical portion of the inlet passage, and a fluid trap portion positioned between the inlet and outlet passages, the fluid trap portion being directly connected to the vertical portion of the inlet passage and the vertical portion of the outlet passage, the vertical portion of the outlet passage being positioned vertically above the fluid trap portion, the fluid trap portion being positioned vertically above the vertical portion of the inlet passage, the inlet and outlet passages overlapping at least partially with respect to each other in an axial direction over an overlapping portion, at least one guide trough positioned between fluid trap portion and the outlet passage, the guide trough directing fluids from the outlet passage towards the fluid trap portion when the vacuum system does not draw fluids from the floor surface, such that the fluids from the outlet passage are prevented from flowing to the overlapping portion of the inlet passage, the reservoir permitting passage therethrough of fluids suctioned by the vacuum system from the floor to the recovery hose, the fluid trap portion trapping a backflow of fluids from the recovery hose in the fluid trap portion when the vacuum system stops suctioning fluids from the floor to the recovery hose, the reservoir shaped to be generally self-cleaning such that the reservoir clears most fluids trapped in the fluid trap portion when the vacuum system starts suctioning fluids from the floor to the recovery hose.

17. A fluid recovery system for a floor surface maintenance machine, comprising:

a squeegee assembly adapted to engage the floor surface;

a vacuum system operably coupled to the squeegee assembly, the vacuum system applying a suction force on fluids on the floor surface;

a fluid suction path extending from the squeegee assembly to a fluid recovery tank, the fluid suction path operably coupled to the vacuum system such that the vacuum system draws fluids from the floor surface through the fluid suction path due to the suction force;

a recovery hose forming part of the fluid suction path and leading to the fluid recovery tank;

a reservoir forming part of the fluid suction path and operably coupled to the recovery hose, the reservoir being a single monolithic part, the reservoir comprising:

an inlet passage disposed about an inlet axis, an outlet passage operably connected and leading to the recovery hose, the outlet passage being disposed about an outlet axis, the outlet axis being generally parallel to the inlet axis, and a fluid trap portion positioned between the inlet and outlet passages, the fluid trap portion being shaped and oriented so as to be non- perpendicular to each of the inlet axis and the outlet axis, the fluid trap portion comprising a collection area for collecting fluids, a vacuum flow associated with the vacuum system flowing through at least a portion of the collection area, the inlet and outlet passages overlapping at least partially with respect to each other in an axial direction over an overlapping portion, at least one guide trough positioned between fluid trap portion and the outlet passage, the guide trough directing fluids from the outlet passage towards the fluid trap portion when the vacuum system does not draw fluids from the floor surface, such that the fluids from the outlet passage are prevented from flowing to the overlapping portion of the inlet passage, the reservoir permitting passage therethrough of fluids suctioned by the vacuum system from the floor to the recovery hose, the fluid trap portion trapping a backflow of fluids from the recovery hose in the fluid trap portion when the vacuum system stops suctioning fluids from the floor to the recovery hose, the shape and orientation of the fluid trap portion permitting the reservoir to be generally self-cleaning such that the reservoir clears most fluids trapped in the fluid trap portion when the vacuum system starts suctioning fluids from the floor to the recovery hose.

18. The fluid recovery system of claim 17, wherein, the inlet axis and the outlet axis are each generally perpendicular to the floor surface.

19. The fluid recovery system of claim 18, wherein the inlet axis and the outlet axis are each generally parallel to a direction of vacuum flow at the inlet passage.

* * * * *